US009387949B2

(12) United States Patent
Honegger

(10) Patent No.: US 9,387,949 B2
(45) Date of Patent: Jul. 12, 2016

(54) APPARATUS AND METHOD FOR PLACING BAGS OVER INSERTION TUBE IN BALE ENVELOPING APPARATUS

(71) Applicant: Chris Allen Honegger, Bluffton, IN (US)

(72) Inventor: Chris Allen Honegger, Bluffton, IN (US)

(73) Assignee: Rethceif Enterprises, LLC, Ossian, IN (US)

( * ) Notice: Subject to any disclaimer, the term of this patent is extended or adjusted under 35 U.S.C. 154(b) by 516 days.

(21) Appl. No.: 13/912,399

(22) Filed: Jun. 7, 2013

(65) Prior Publication Data

US 2014/0360140 A1 Dec. 11, 2014

(51) Int. Cl.

| | |
|---|---|
| ***B65B 43/46*** | (2006.01) |
| ***B65B 27/12*** | (2006.01) |
| ***B65B 39/06*** | (2006.01) |
| ***B65B 43/30*** | (2006.01) |
| *B65B 39/02* | (2006.01) |
| *B65B 7/04* | (2006.01) |

(52) U.S. Cl.

CPC ..... *B65B 27/125* (2013.01); *B65B 39/06* (2013.01); *B65B 43/30* (2013.01); *B65B 7/04* (2013.01); *B65B 39/02* (2013.01)

(58) Field of Classification Search

CPC .... B65B 27/125; B65B 43/30; B65B 43/465; B65B 43/26; B65B 43/42; B65B 43/46; B65B 39/06; B65B 39/02; B65B 39/12; B65B 39/007; B65B 7/04; B65B 45/00; B65B 63/026; B65B 9/13; B65B 9/2028

USPC ..... 53/439, 459, 469, 530, 567

See application file for complete search history.

(56) References Cited

U.S. PATENT DOCUMENTS

| | | | | |
|---|---|---|---|---|
| 7,356,978 | B2 * | 4/2008 | Dall'Omo | B65B 25/143 53/450 |
| 7,891,156 | B2 * | 2/2011 | Beer | B29C 65/7451 53/433 |
| 2009/0229226 | A1 * | 9/2009 | Beeland | B65B 27/125 53/540 |
| 2009/0241474 | A1 * | 10/2009 | Actis | B65B 5/045 53/456 |
| 2011/0011035 | A1 * | 1/2011 | Praestholm | B30B 9/3014 53/438 |

FOREIGN PATENT DOCUMENTS

| | | | | |
|---|---|---|---|---|
| DE | 10046852 | A1 * | 4/2002 | B65B 43/28 |

* cited by examiner

*Primary Examiner* — Thanh Truong
*Assistant Examiner* — Thomas Wittenschlaeger
(74) *Attorney, Agent, or Firm* — George Pappas

(57) ABSTRACT

An apparatus for placing preformed bags having an open end and a closed end over an insertion tube for inserting a bale therethrough and into the bag. A plurality of fingers are inserted into the bag open end and are extended for engaging the bag. The fingers and bag opening are traversed to the tube thereby inserting the tube end into the bag opening. The fingers are retracted and removed from the bag. The insertion tube is expanded thereby engaging the interior surface of the bag. Roller drive wheels are placed on the bag over the insertion tube and are rotatably driven and are traversed along the insertion tube for collecting the bag thereon. The roller drive wheels and the plurality of fingers are carried on a common assembly movable along the insertion tube.

9 Claims, 44 Drawing Sheets

APPARATUS AND METHOD FOR PLACING BAGS OVER INSERTION TUBE IN BALE ENVELOPING APPARATUS

BACKGROUND OF THE INVENTION

1. Field of the Invention

The present invention relates to the field of enveloping generally rectangular shaped bales of material such as cotton, trash, etc. and, more particularly, relates to the use of a web of closed, preformed end-to-end bags for enveloping bales and an apparatus and method for placing the bags over an insertion tube.

2. Background

Bulk materials such as cotton, insulation, trash, cloth, scraps, recyclables, etc. are today typically packaged by compressing binding into large rectangular bales. Oftentimes, it is desirable to envelop such bales with a protective covering material which is typically made of plastic such as polyethylene and polypropylene. Cotton bales, for example, are today enveloped in plastic bags so as to protect the cotton during transport. Bales of trash are also similarly enveloped so that, during transport, trash pieces that may fall off the bale will be contained.

Such bales are today enveloped by essentially manually inserting them into large bags and manually closing and sealing the bags. As can be appreciated, this process can be time-consuming and costly. Accordingly there is a need for an automated method and apparatus for enveloping rectangular bales and, more particularly, for automatically placing bags on an insertion tube for inserting bales therein.

SUMMARY OF THE INVENTION

In one form thereof the invention is used in connection with an apparatus for enveloping bales of material with preformed bags having an open end and a closed end, and is directed to an apparatus for placing the bags over an insertion tube comprising: a plurality of fingers, said fingers being moveable between said open bag and over the insertion tube and being selectively retractable and extendable; and, a plurality of roller drive wheels, said roller drive wheels being rotatable and moveable in and out of engagement with the insertion tube.

Preferably, one or more fingers are secured and extend from a first rotatable shaft and one of more fingers are secured to and extend from a second rotatable shaft, whereby said first and second shafts are selectively rotated for selectively retracting and extending said fingers.

Preferably, one or more roller drive wheels are mounted on a first selectively rotatable shaft and one or more roller drive wheels are selectively mounted on a second selectively rotatable shaft, said rotatable shafts also being selectively moveable for placing the wheels mounted thereon in and out of engagement with the insertion tube.

Preferably, said roller drive wheels are also moveable along the insertion tube.

Also preferably, said plurality of fingers and said roller drive wheels are carried on a common assembly which is moveable along the insertion tube.

Preferably, the insertion tube comprises a pair of tube sections, said tube sections selectively moveable between retracted and expanded positions.

Preferably, said plurality of fingers each include a rubber tip whereby the interior bag surface is frictionally engaged.

In another form thereof the invention is used in connection with an apparatus for enveloping bales of material with preformed bags having an open end and a closed end, and is directed to an apparatus for placing the bags over an insertion tube comprising: a plurality of fingers, said fingers being moveable between said open bag and over the insertion tube and being selectively retractable and extendable; and, a plurality of frictional engagement members, said frictional engagement members being moveable along the insertion tube and being moveable in and out of engagement with the insertion tube.

In yet another form thereof the invention is used in connection with a method for enveloping bales of material with preformed bags having an open end and a closed end, and the invention is directed to placing a bag over the insertion tube comprising the steps of: inserting a plurality of fingers into said bag through said open end; extending said fingers and engaging the bag; traversing said fingers relative to the insertion tube and inserting the insertion tube into said bag opening; retracting said fingers; and, removing said fingers from inside said bag and leaving the bag on said insertion tube.

The method preferably includes, after the step of removing, placing a plurality of roller drive wheels on said bag and sandwiching the bag between the insertion tube and each of said wheels, and rotatably driving said wheels thereby slidingly collecting said bag on said insertion tube.

The method also preferably includes, prior to said step of placing, expanding and locating said insertion tube in close proximity to the interior surface of the bag.

The method preferably includes inserting a bale through said insertion tube and into the bag thereby removing the bag from the insertion tube and enveloping the bale.

The method preferably includes expanding and locating said insertion tube in close proximity to the interior surface of the bag.

The method also preferably includes, after the step of removing, placing a plurality of frictional engagement members on said bag and sandwiching the bag between the insertion tube and each of said members, and traversing said members along said insertion tube thereby slidingly collecting said bag on said insertion tube.

The method preferably includes, after the step of removing, placing a plurality of roller drive wheels on said bag and sandwiching the bag between the insertion tube and each of said wheels, and traversing said wheels along said insertion tube and rotatably driving said wheels thereby slidingly collecting said bag on said insertion tube.

BRIEF DESCRIPTION OF THE DRAWINGS

The above mentioned and other features of this invention, and the manner of attaining them, will become more apparent and the invention itself will be better understood by reference to the following description of the embodiments of the invention taken in conjunction with the accompanying drawings, wherein.

Figure 1:
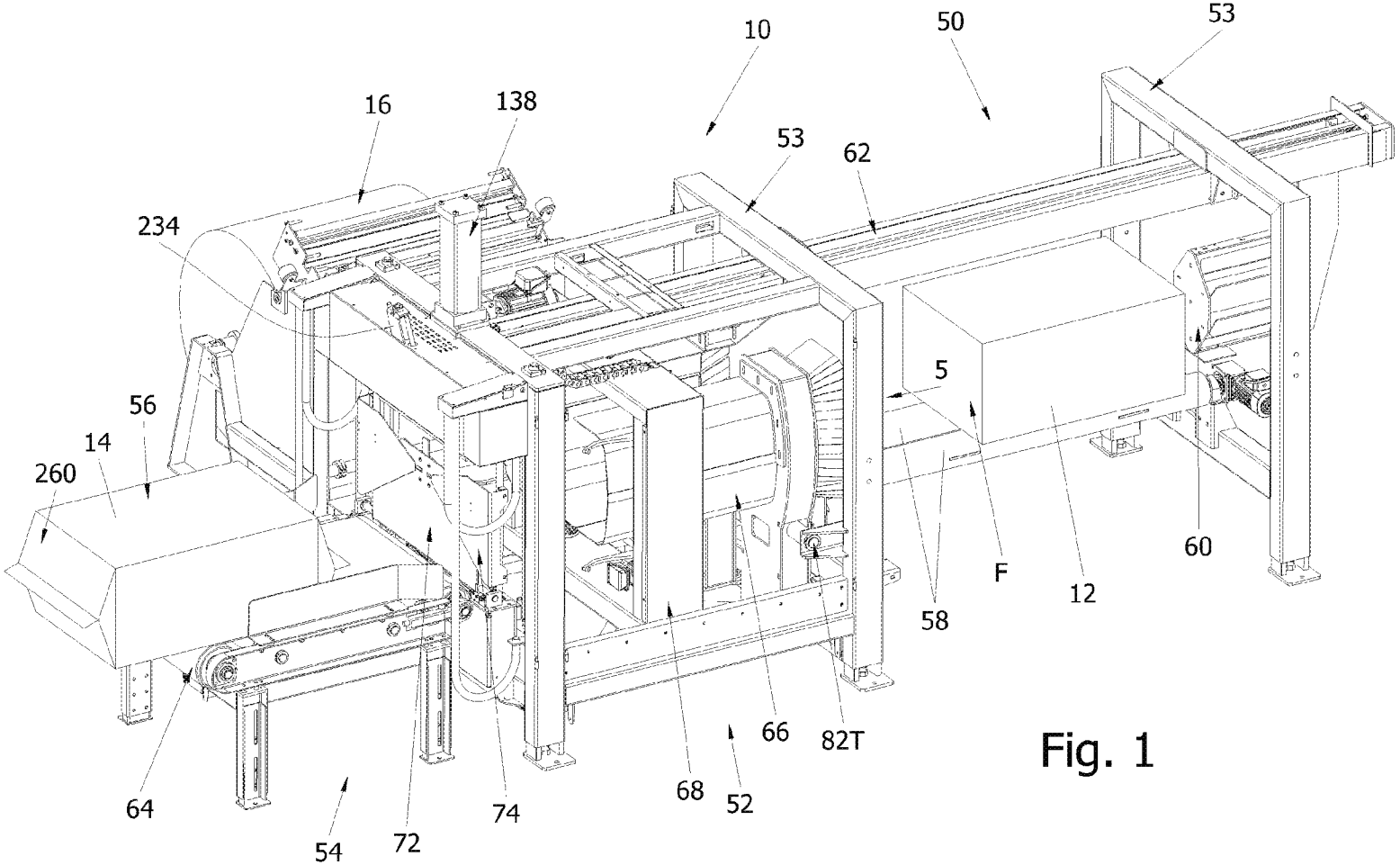
FIG. 1 is a perspective view of an apparatus constructed in accordance with the principles of the present invention for enveloping rectangular bales.

Corresponding reference characters indicate corresponding parts throughout several views. Although the exemplification set out herein illustrates embodiments of the invention, in several forms, the embodiments disclosed below are not intended to be exhaustive or to be construed as limiting the scope of the invention to the precise forms disclosed.

DETAILED DESCRIPTION OF THE PREFERRED EMBODIMENTS

Figure 2:
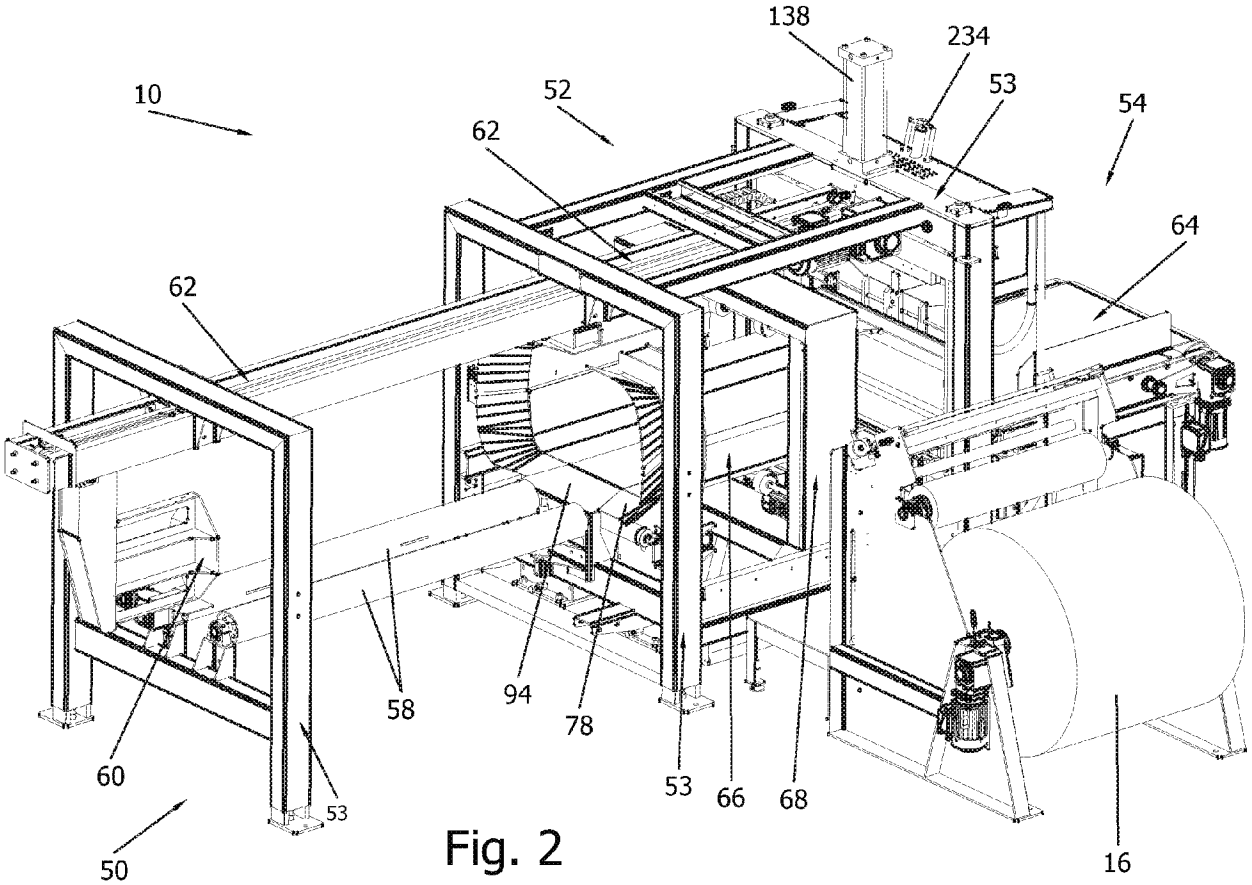
FIG. 2 is another perspective view of the apparatus shown in FIG. 1.

An apparatus constructed in accordance with the principles of the present invention for enveloping bales 12 is shown in FIGS. 1 and 2 and generally designated by the numeral 10. Bales 12 are typically bales of bulk material including but not limited to cotton, trash, textiles, etc. which has been bound into a generally rectangular shape, although it is contemplated that bales 12 can be other items and things which are generally rectangular shaped. Apparatus 10 employs a plurality of closed, preformed end-to-end bags 14, in a continuous web 15 which is provided on a roll 16, and automatically severs each hag 14 from the roll 16, opens and inserts a bale 12 therein, and closes and seals the bag for thereby enveloping the bale 12.

The closed, preformed end-to-end bags 14 and method of making them are diagrammatically shown and depicted in FIGS. 3-9. Bags 14 are made from an elongate sheet of material 18 preferably made of polypropylene and/or woven polypropylene having a typical thickness of 0.001 to 0.006 inch. Sheet 18 can be provided in substantially any length and/or can be simultaneously provided while the bags 14 are being made. Sheet 18 has opposing longitudinal ends 20, 22 and first and second opposing side edges 24, 26 extending between the opposing longitudinal ends 20 and 22.

Figure 4:
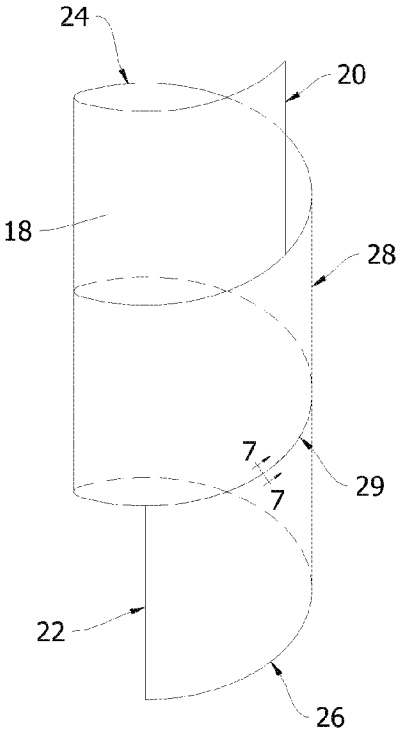
FIG. 4 is a diagrammatic partial side elevation view of a helix tube formed with the elongate sheet of material shown in FIG. 3.
Figure 3:
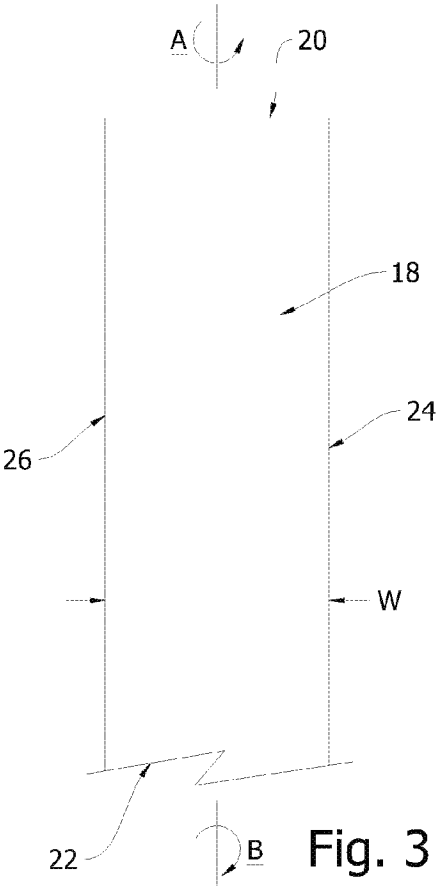
FIG. 3 is a diagrammatic partial plan view of an elongate sheet of material used in making a plurality of closed preformed end-to-end bags which are employed by the enveloping apparatus for enveloping rectangular bales.
Figure 5:
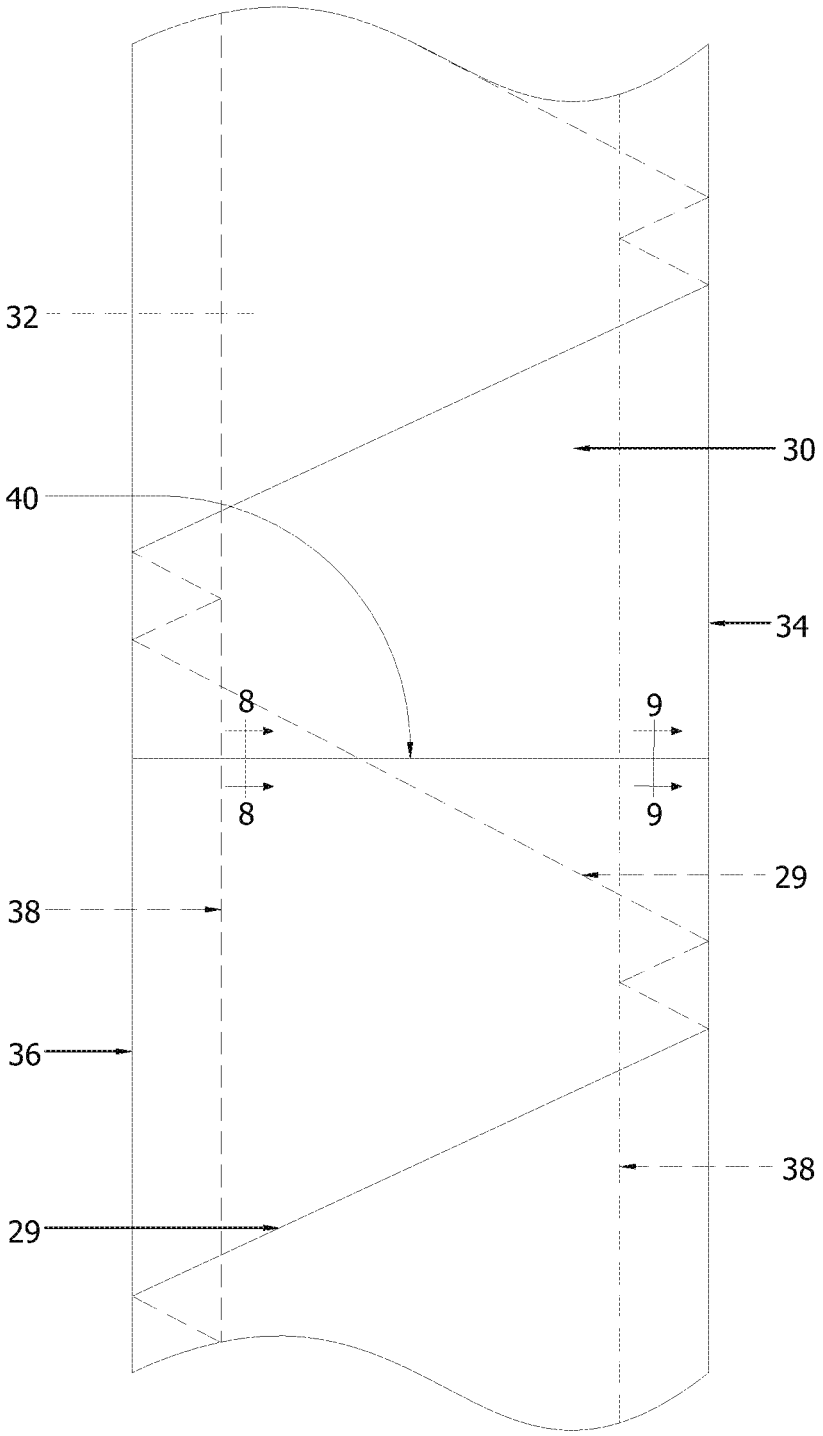
FIG. 5 is a diagrammatic partial plan view of the helix tube shown in FIG. 4 which has been flattened and sewn into a plurality of closed preformed end-to-end bags.
Figure 6:
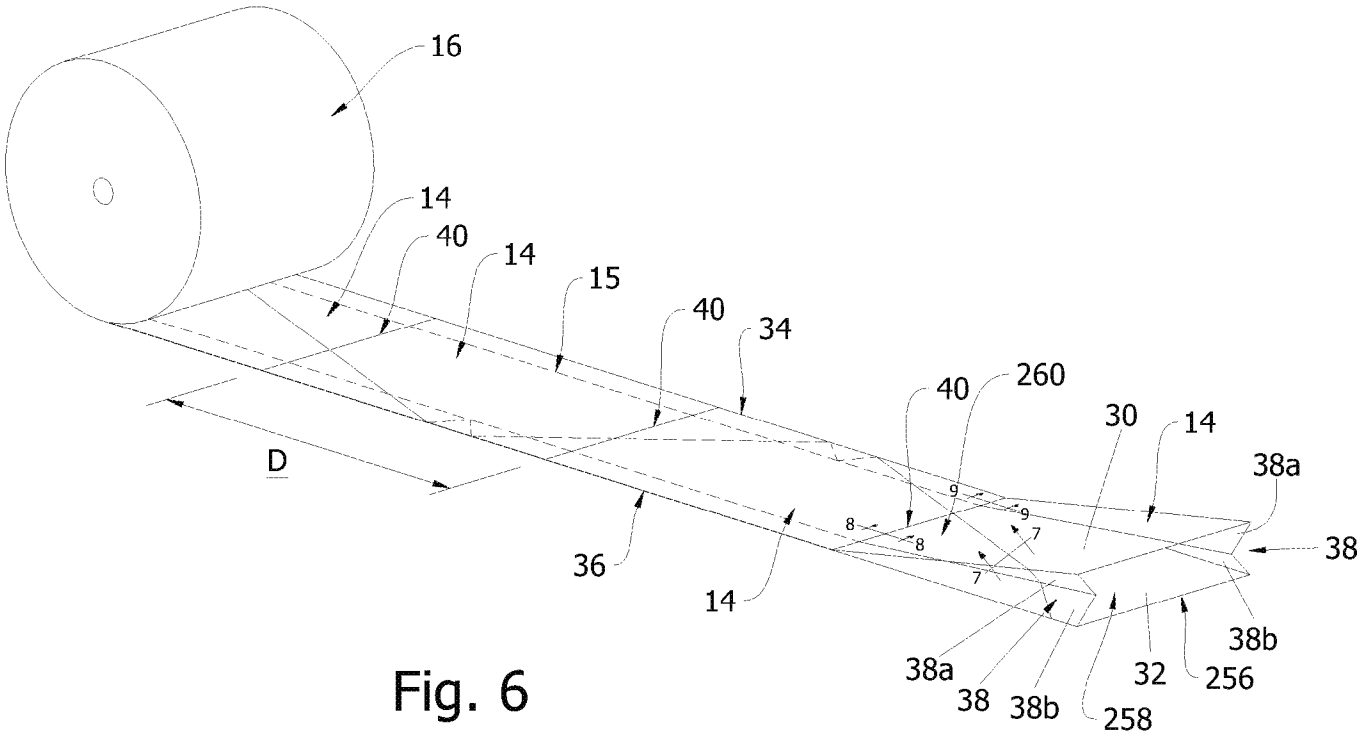
FIG. 6 is a perspective view of the plurality of closed preformed end-to-end bags shown in FIG. 5 provided on a roll for use in the enveloping apparatus.

Sheet 18 is formed into a helix tube 28, as shown in FIG. 4, by twisting its opposing ends 20, 22 in relative opposite directions, as diagrammatically depicted by arrows A and B in FIG. 3 and, thereafter, securing the first and second side edges 24, 26 to one another along a helix seam 29. The helix tube 28 is then flattened thereby forming opposing first and second elongate bag walls 30, 32 joined at opposing side fold edges 34, 36. Preferably, gussets 38 comprising gusset walls 38*a*, 38*b* are provided at each of the side fold edges 34, 36. The opposing first and second elongate bag walls 30, 32 are, thereafter, secured to one another along seam lines 40, each of which extend between and generally transverse to the side fold edges 34, 36. Seam lines 40 are spaced longitudinally from one another at desired spaced distances D.

Accordingly, each of the closed preformed end-to-end bags 14 are thereby defined between side fold edges 34, 36 and between each spaced pair of seam lines 40. Each of the closed preformed end-to-end bags 14 have an effective length D and an effective perimeter length equivalent to the perimeter of the helix tube 28. The plurality of thus formed end-to-end bags 14 form a continuous elongate web 15 and can be rolled up into a roll 16 for easily transporting and use in apparatus 10.

It is contemplated that, rather than making a helix tube 28, bags 14 can be made by folding over the sheet 18 along a longitudinally extending fold line and securing seams 24 and 26 to one another, thereby creating a seam extending longitudinally in a straight line between the longitudinal ends 20, 22. In such an embodiment, the effective perimeter length of the bag 14 would be limited to and would be substantially equivalent to the width W of the elongate sheet 18. However, as should now be appreciated, by forming a helix tube 28 the effective perimeter length of the bag 14 can be made whatever length may be desired for accommodating and enveloping the bales 12.

The securing of the first and second side edges 24, 26 at seam line 29 and of the first and second bag walls 30, 32 at seam lines 40 can be accomplished by heat sealing and/or with adhesives. Preferably, however, this is accomplished by sewing for thereby providing generally low cost high strength securement seams. In this regard, as diagrammatically shown in FIG. 7, at seam 29, the side edges 24, 26 are overlapped and bent over for thereby forming an inner U-shape 42 along side edge 26 which is nested within an outer U-shape 44 formed along the side edge 24. The legs of the nested U-shapes 42, 44 are sewn together with thread 45 for thereby securing side edges 24, 26 to one another.

Figure 8:
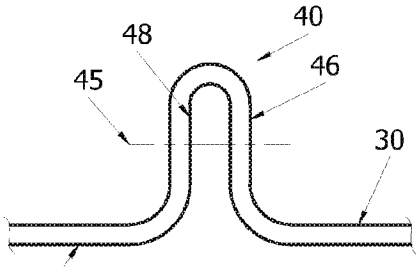
FIG. 8 is a cross-sectional view taken along line 8-8 of FIGS. 5 and 6.

Similarly, as diagrammatically shown in FIG. 8, at seam 40, the first bag wall 30 is formed into an outer U-shape 46 and the second bag wall 32 is formed into an inner U-shape 48. The inner U-shape 48 is nested within the outer U-shape 46. The legs of the nested U-shapes 46, 48 are sewn together with thread 45 for thereby securing the first and second bag walls 30, 32 to one another.

Figure 9:
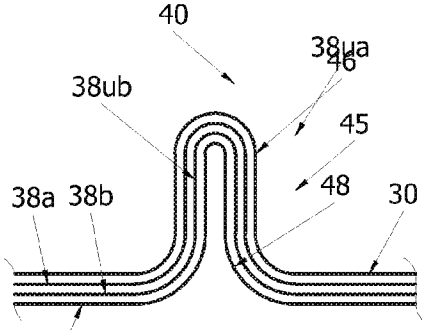
FIG. 9 is a cross-sectional view taken along line 9-9 of FIGS. 5 and 6.
Figure 7:
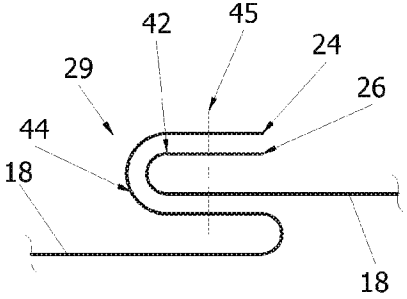
FIG. 7 is a cross-sectional view taken along line 7-7 of FIGS. 4 and 6.
Figure 10:
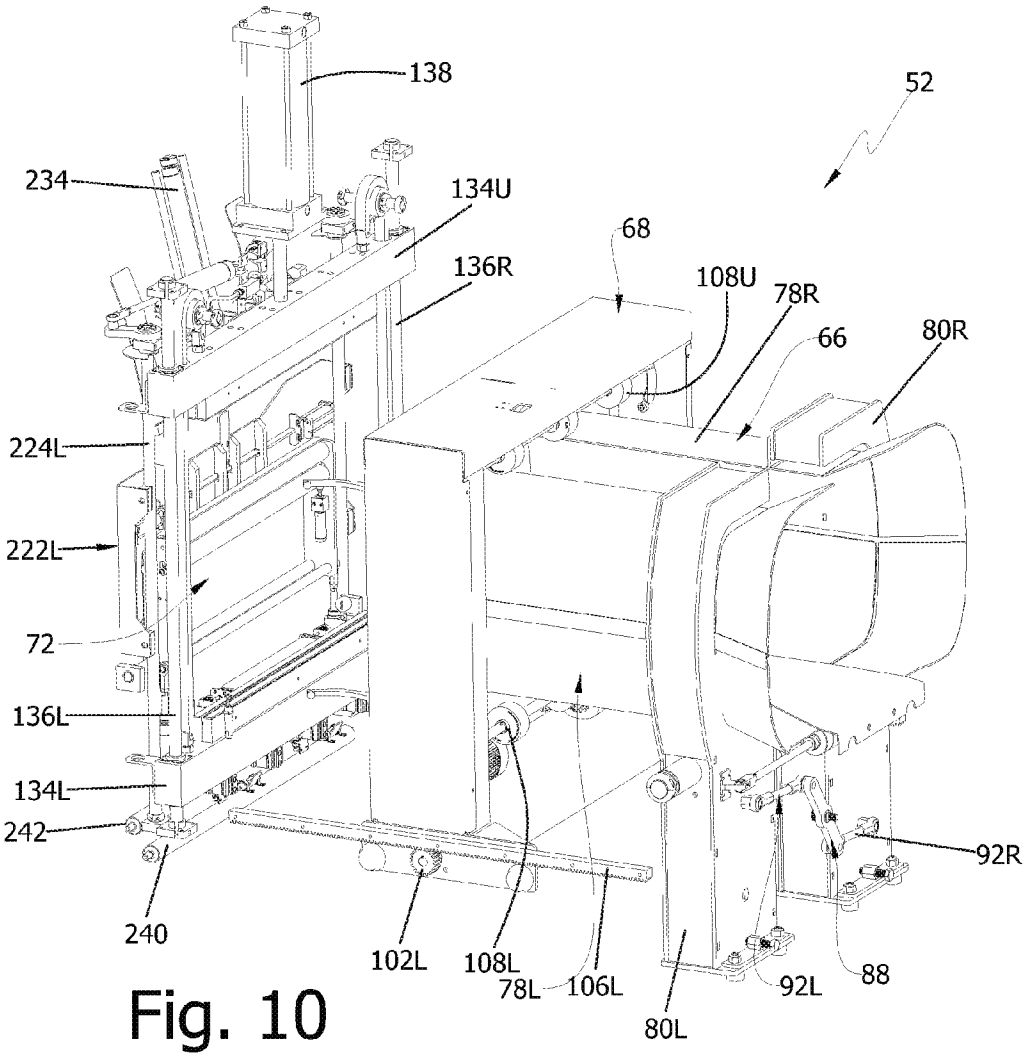
FIG. 10 is a perspective view of the assembly within the apparatus whereat the closed preformed end-to-end bags are severed from the roll, opened and placed over a bale, and are closed and heat sealed.

As shown in FIG. 9, in the area of gussets 38, the inner U-shape 48 of the second bag wall 32 is similarly nested within the outer U-shape 46 of the first bag wall 30. Here, however, the gusset walls 38*a*, 38*b* are also formed into respective U-shapes 38Ua, 38Ub which are sandwiched between the outer and inner U-shapes 46, 48. The legs of these nested U-shapes 46, 38Ua, 38Ub and 48 are sewn together with thread 45 for thereby securing the first and second bag walls 30, 32 and the gusset walls 38*a*, 38*b* all together.

Turning now to FIGS. 1 and 2, the bale enveloping apparatus 10 generally includes: an infeed section 50 whereat bales 12 are received; an assembly 52 whereat bags 14 are severed from roll 16, opened and placed over a bale 12, and are closed and heat sealed; and, an output section 54 whereat the enveloped/wrapped bales 56 are presented. Infeed section 50 includes a set of low surface friction support rollers 58 whereupon bales 12 are placed and then slid, as indicated by arrow 8, towards and into the assembly 52. Bales 12 are slid longitudinally along the support rollers 58 and into the assembly 52 with a ram 60 which is adapted to engage the rear end of the bale 12 and traverse along the drive track 62. At the output section 54, the enveloped bales 56 exiting the assembly 52 are received on the output conveyor 64 and transported longitudinally away therefrom. It is noted that, as further described hereinbelow, the output conveyor 64 effectively transports the enveloped bale 56 while the bag 14 is being closed and sealed. Also, ram 60 effectively pushes the bale 12, at least partially through the assembly 52, during the enveloping process and until the enveloped bale 56 is sufficiently supported on the output conveyor 64 for transport thereon.

The assembly 52 whereat bags 14 are severed from roll 16, opened and placed over a bale 12, and are closed and heat sealed, as best seen in FIGS. 10-13, includes: an adjustable insertion tube, also referred herein as a form tube 66; a bag placer assembly 68; a bag severing, opening and sealing assembly 70; a bottom fold plate assembly 72; a side folds assembly 74; and, a top fold assembly 76. The assembly 52 and the several components thereof are mounted and supported within the apparatus frame 53. The assembly 52 is shown in FIGS. 10-13 with the frame 53 removed for clarity and ease of depicting the several components thereof.

Figure 15:
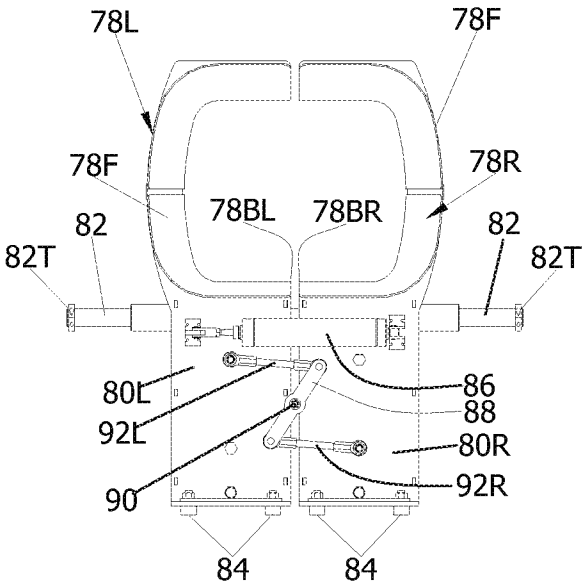
FIG. 15 is a front elevation view of the form tube shown in FIG. 14 and showing the form tube in its retracted position.
Figure 14:
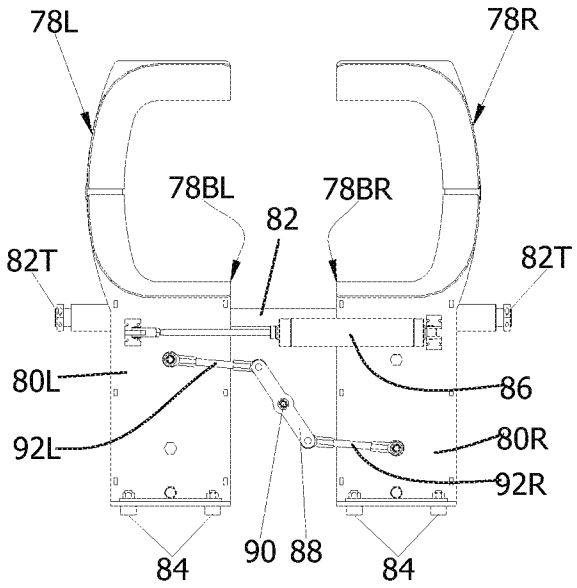
FIG. 14 is a front elevation view of the form tube which is part of the assembly shown in FIG. 12 and showing the form tube in its expanded position.
Figure 16:
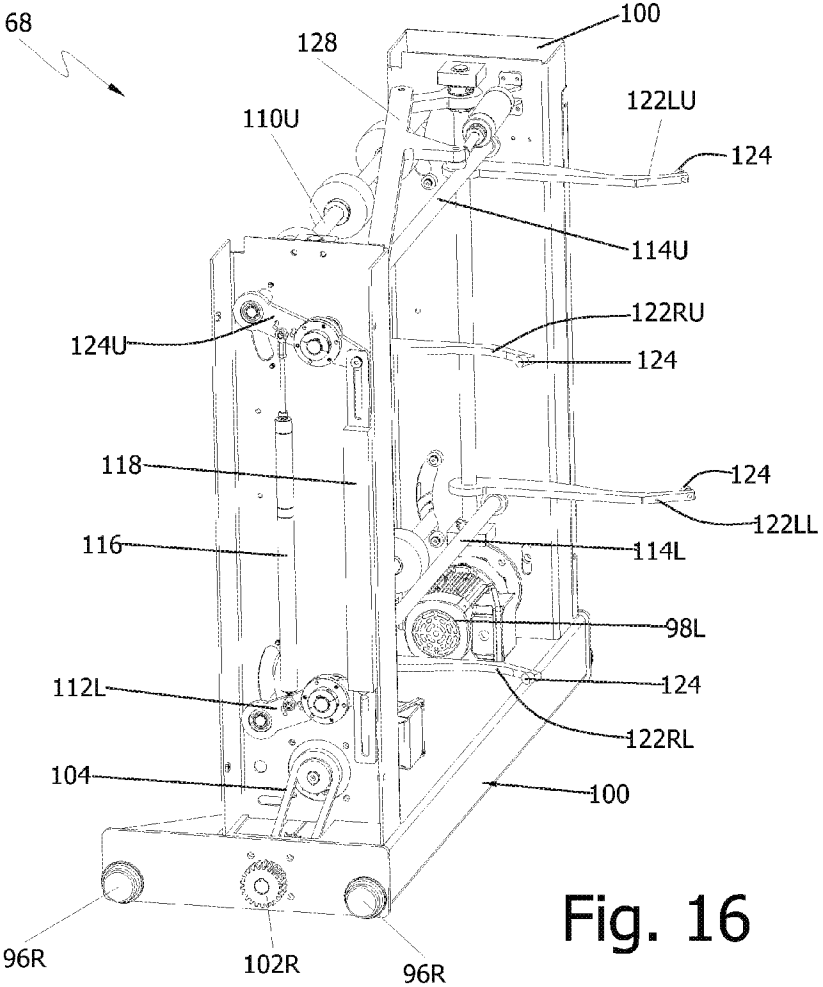
FIG. 16 is a perspective view of the bag placer assembly which is part of the assembly shown in FIG. 12.

The adjustable form tube 66, as also shown in FIGS. 14 and 15, includes left and right form tube sections 78L, 78R supported on respective horseshoe frames 80L, 80R. Horseshoe frames 80L, 80R are slidingly supported on a horizontal tube 82 which is mounted at its terminal ends 82T to the frame 53 and extends generally transverse to the longitudinal line of travel of the bales 12. Rollers 84 are provided at the lower end of each of the horseshoe frames 80L, 80R and ride in a frame trade (not shown). An air cylinder 86 is secured between the horseshoe frames 80L, 80R. Air cylinder 86 is selectively extendable and retractable for thereby selectively separating the form tube sections 78L, 78R and placing the form tube 66 in its expanded position as shown in FIG. 14, and for thereby selectively contracting the form tube sections 78L, 78R and placing the form tube 66 in its retracted position as shown in FIG. 15. As should be appreciated, the horizontal tube 22 and rollers 84 together maintain the horseshoe frames 80L, 80R positioned vertical as shown while the horseshoe frames 80L, 80R slide between their retracted and extended positions.

A pivot arm 88 is pivotally secured at a central pivot joint 90 to the frame 53. Links 92L, 92R are provided and are pivotally secured at one of their ends to each of the terminal ends of the pivot arm 88. At its other end, link 92L is pivotally secured to the left horseshoe frame 80L, whereas link 92R, at its other end, is pivotally secured to the right horseshoe frame 80R. As should now be appreciated, pivot arm 88 and links 92L, 92R function to maintain the horseshoe frames 80L, 80R and form tube sections 78L, 78R evenly spaced from the central pivot joint 90 as the form tube sections 78L, 78R are moved between their retracted and expanded positions.

The form tube sections 78L, 78R each include a front flared surface 78F for helping guide the bales 12 into the form tube 66 as they are pushed therein with the ram 60. Form tube sections 78L, 78R each also include a rear edge 78E and exterior surfaces 78SR, 78SR whereupon opened bags 14 are received as further described hereinbelow. An apron 94 extends into the adjustable form tube 66 over the bottom longitudinal edges 78BL, 78BR. Bales 12 traverse over the apron 94 as they are pushed through the form tube 66. The bottom longitudinal edges 78BL, 78BR thereby slide under the apron 94 as the left and right form tube sections 78L, 78R are moved between their retracted and expanded positions without interfering with or contacting the bales 12.

The bag placer assembly 68, as more fully described hereinbelow, grabs an opened bag 14, places the open bag end over the form tube rear edges 78E and on the form tube exterior surfaces 78SL, 78SR and then collects the bag on the form tube 66 placing it in position ready for inserting a bale 12 therein. For accomplishing its intended operations, bag placer assembly 68 is selectively longitudinally movable between the positions shown in FIGS. 46-53. In this regard, bag placer assembly 68 is provided with rollers 96L, 96R pivotally mounted to the bag placer assembly frame 100 and adapted to ride in respective left and right frame trades (not shown) mounted on the frame 53. Rollers 96L, 96R, hence, carry the bag placer assembly 68 longitudinally between the positions shown in FIGS. 46-53.

Bag placer assembly 68 is selectively longitudinally movable by selectively energizing electric motors 98L, 98R which are mounted on the bag placer assembly frame 100. Electric motors 98L, 98R are coupled to respective spur gears 102L, 102R through toothed belts 104. Spur gears 102L, 102R R, in tarn, are coupled to respective left and right gear racks 106L, 106R which are mounted to the frame 53.

Figure 17:
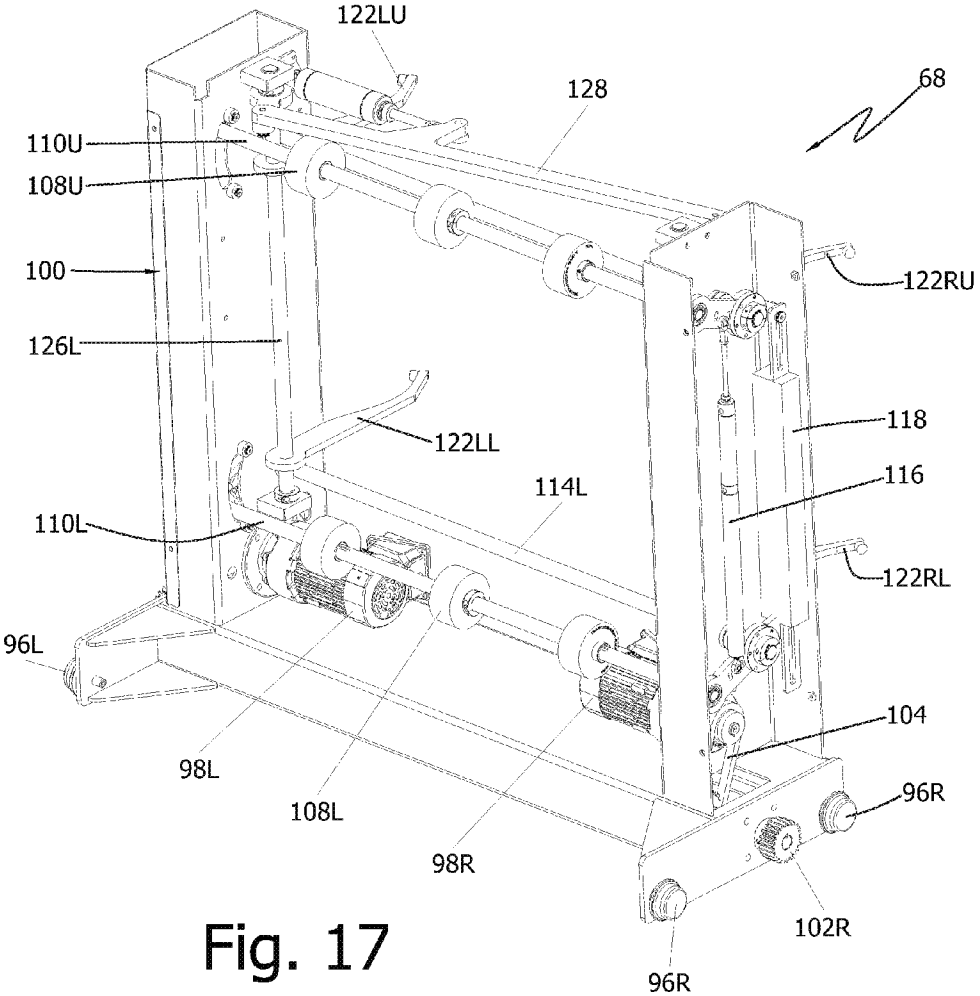
FIG. 17 is another perspective view of the bag placer assembly shown in FIG. 16 and showing the bag roller drive wheels in their retracted position.
Figure 18:
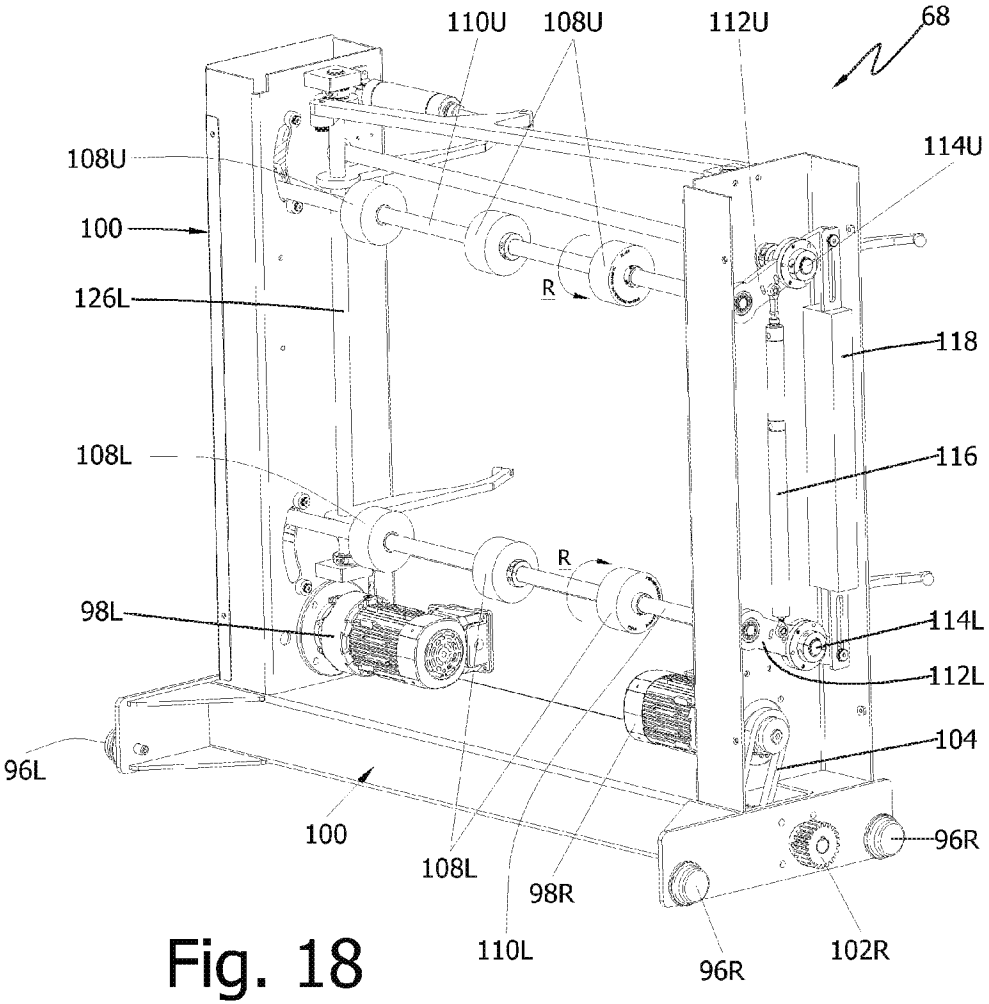
FIG. 18 is a perspective view of the bag placer assembly similar to FIG. 17 and showing the bag roller drive wheels in their extended in-use position.

Upper and lower bag roller drive wheels 108U, 108L are mounted on respective upper and lower rotatable shafts 110U, 110L. The upper rotatable shaft 110U is carried on upper pivot arms 112U which are, in turn, carried on and pivotally supported on an upper pivot shaft 114U. The lower rotatable shaft 110L is carried on lower pivot arms 112L which are, in turn, carried on and pivotally supported on a lower pivot shaft 114L. Air cylinders 116 are provided and are pivotally coupled between the upper and lower pivot arms 112U, 112L. As depicted between FIGS. 17 and 18, by selectively extending and retracting air cylinders 116, the upper rotatable shaft 110U and the roller drive wheels 108U thereof are selectively movable toward and away from the lower rotatable shaft 110L and the roller drive wheels 108L thereof. As should now also be appreciated, when form tube 66 is located within the bag placer assembly 68, by selectively extending and retracting air cylinders 116, the upper drive wheels 108U are selectively placed in contact with the form tube left and right exterior surfaces 78SL, 78SR at the top of the form tube 66, and the lower drive wheels 108L are selectively placed in contact with the form tube left and right exterior surfaces 78SL, 78SR at the bottom of the form tube 66. See, for example, FIGS. 46-53. It is noted also that counter weight and extension limit links 118 are provided between the upper and lower pivot arms 112U, 112L for the proper operation thereof as should be appreciated by one skilled in the art.

Electric motors 120 are also provided and are coupled to each of the upper and lower rotatable shafts 110U, 110L for selectively rotatably driving the roller drive wheels 108U, 108L as indicated by arrows R. As further described hereinbelow, electric motors 120 are energized after a bag 14 is placed on the form tube 66 and the upper and lower roller drive wheels 108U, 108L are placed in contact with the bag 14 for collecting the bag 14 on the form tube 66.

Figure 20:
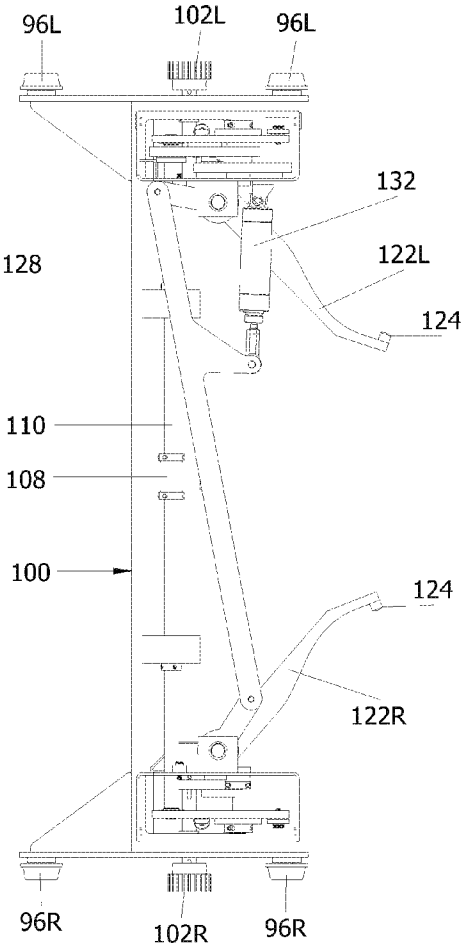
FIG. 20 is a top plan view of the bag placer assembly similar to FIG. 19 and showing the bag placer fingers in their retracted position.
Figure 19:
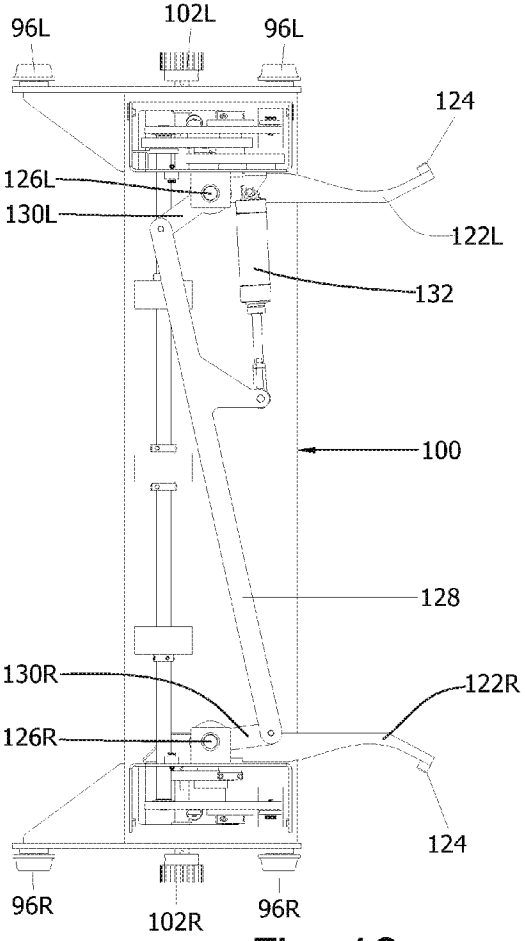
FIG. 19 is a top plan view of the bag placer assembly shown in FIG. 16 and showing the bag placer fingers in their extended in-use position.

Bag placer assembly 68 is also provided with left upper and lower fingers 122LU, 122LL and right upper and lower fingers 122RU, 122RL for placing the open bag end over the form tube rear edges 78E and on the form tube exterior surfaces 78SL, 78SR. At their terminal ends, each of the fingers 122 are provided with a rubber tip 124 for frictionally engaging the interior surface of an open bag 14. The left upper and lower fingers 122LU, 122LL are secured to and extend from a vertical shaft 126L which is pivotally secured to the bag placer assembly frame 100. Similarly, the right upper and lower fingers 122RU, 122RL are secured to and extend from a vertical shaft 126R which is pivotally secured to the frame 100. Vertical shafts 126L, 126R are coupled to one another, as best seen in FIGS. 19 and 20, with a coupling member 128 which extends between and is pivotally connected to an arm 130L affixed to the left vertical shaft 126L and an arm 130R affixed to the right vertical shaft 126R. An air cylinder 132 is pivotally secured between the coupling member 128 and frame 100. Accordingly, by extending air cylinder 132 as shown in FIG. 19, fingers 122 can be extended to their in-use position whereat the rubber tips 124 thereof contact and frictionally engage the interior surface of an open bag 14 so that the open bag end can be placed over the form tube rear edges 78E and on the form tube exterior surfaces 78SL, 78SR. Then, by retracting air cylinder 132 as shown in FIG. 20, fingers 122 can be retracted in a position whereat the rubber tips 124 thereof are out of the way and are not in contact with the interior surface of the bag 14.

Figure 22:
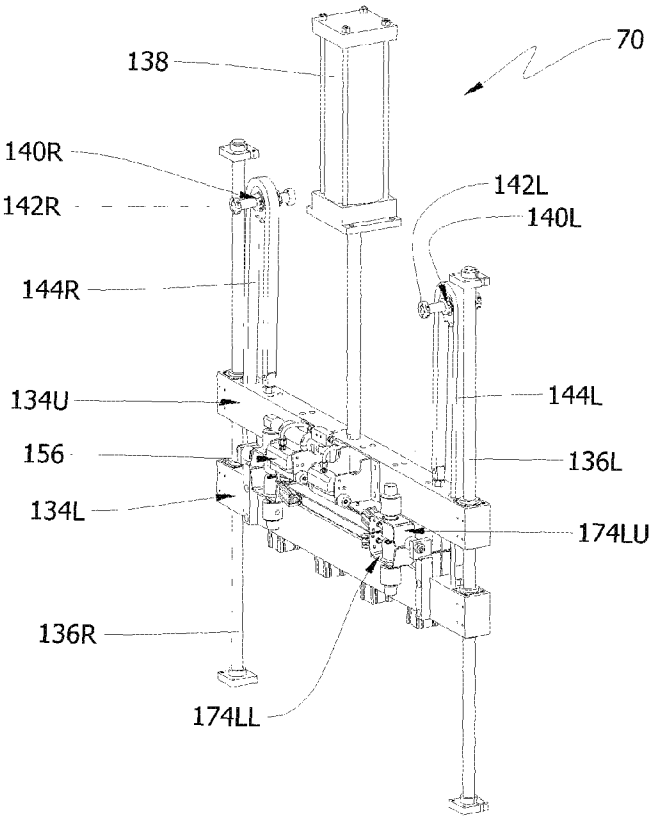
FIG. 22 is a perspective view of the bag severing, opening and sealing assembly similar to FIG. 21 and showing the jaws thereof in their extended closed position.
Figure 21:
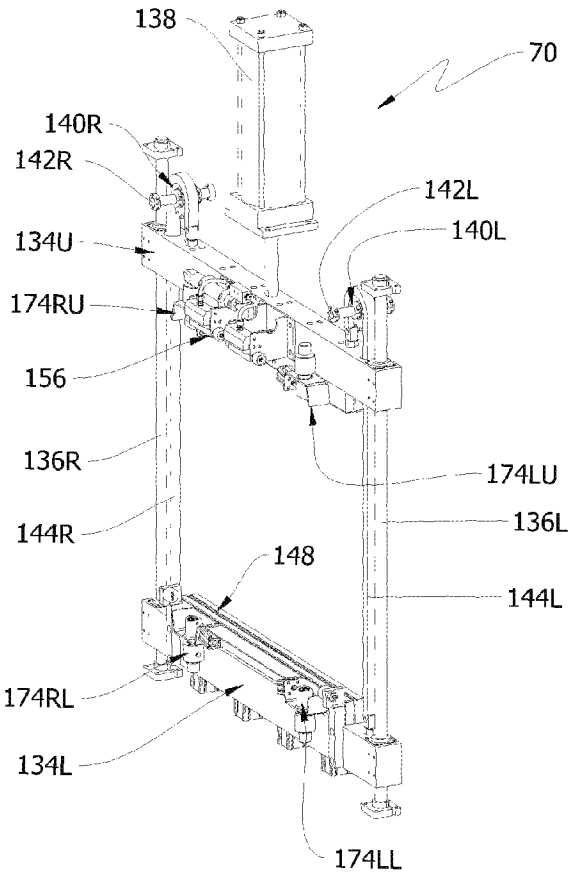
FIG. 21 is a perspective view of the bag severing, opening and sealing assembly which is part of the assembly shown in FIG. 12 and showing the jaws thereof in their retracted open position.
Figure 23:
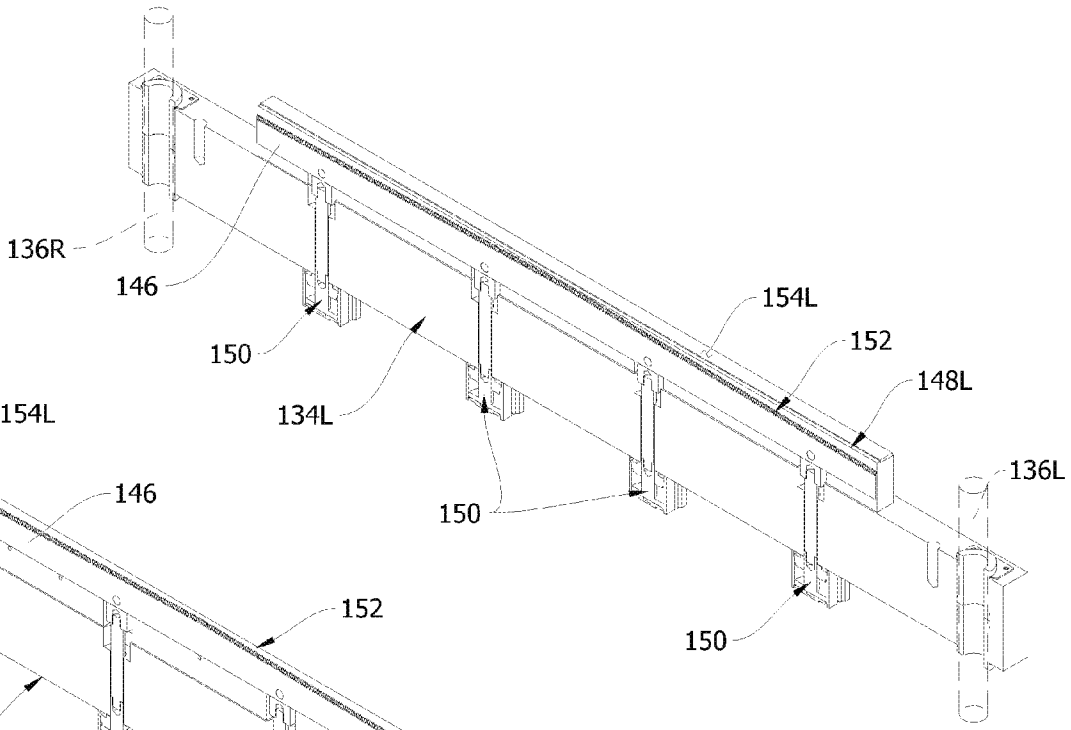
FIG. 23 is a cross-sectional view of the lower jaw of the assembly shown in FIG. 21 taken along line 23-23 and showing the guillotine knife in its retracted position.
Figure 24:
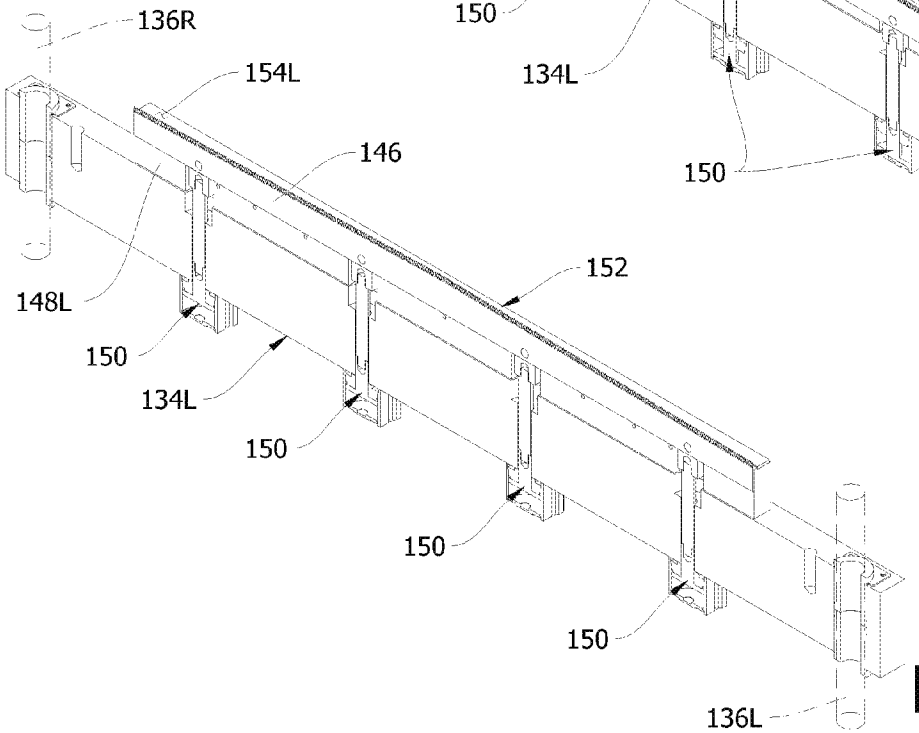
FIG. 24 is a cross-sectional view similar to FIG. 23 and showing the guillotine knife in its extended position.
Figure 25:
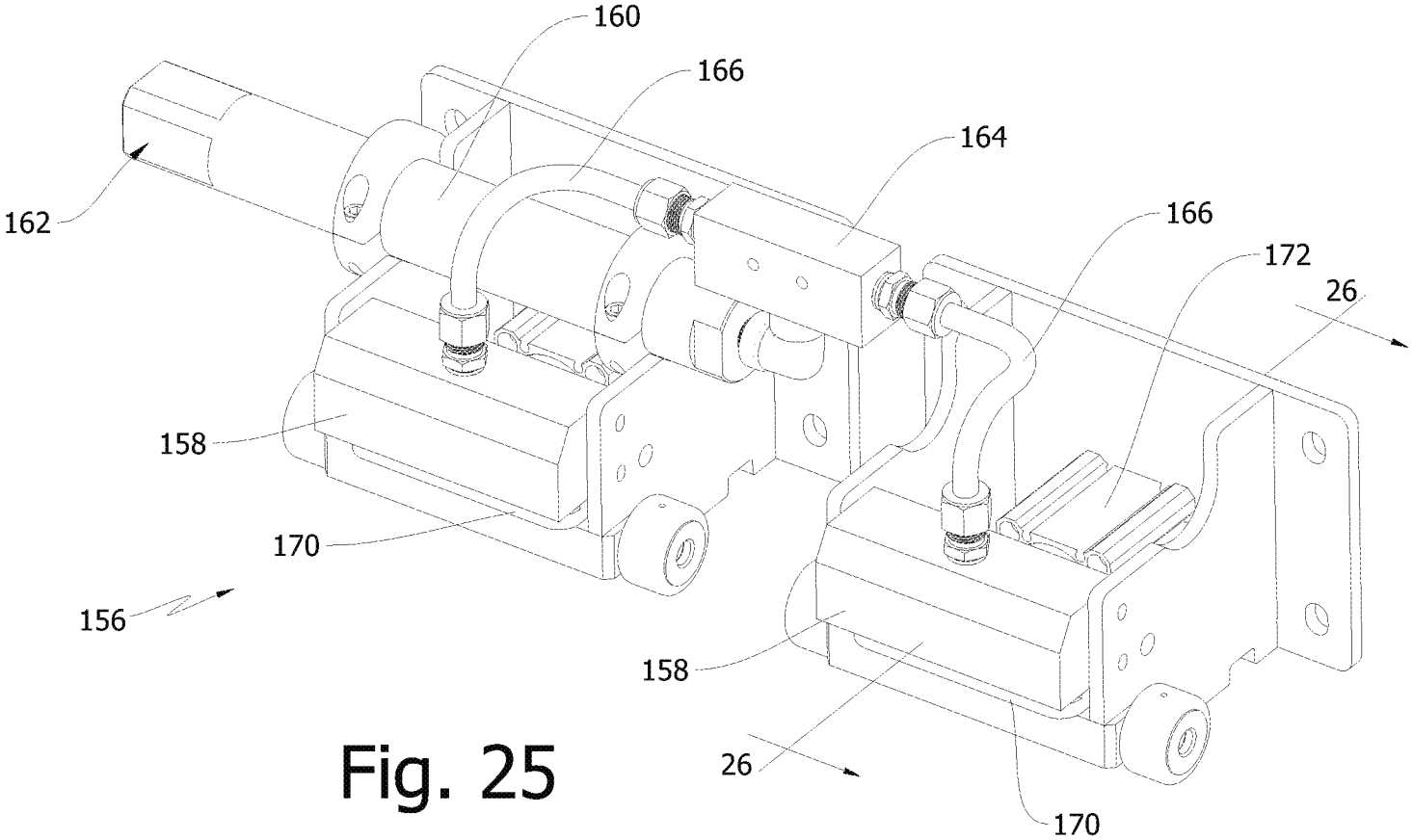
FIG. 25 is a perspective view of the heat sealing assembly which is carried on the upper jaw of the assembly shown in FIG. 21.

Referring now more particularly to FIGS. 21-32, the bag severing, opening and sealing assembly 70 is shown. Assembly 70 includes upper and lower jaws 134U, 134L slidingly mounted on left and right vertical shafts 136L, 136R which are, in turn, secured at their upper and lower terminal ends to the frame 53 (not shown). An air cylinder 138 is secured between the upper jaw 134 and the frame 53 (see also FIG. 1). A pair of toothed pulleys 140L, 140R are provided and are rotatably carried on longitudinally extending shafts 142L, 142R which are secured to the frame 53 (not shown). Toothed belts 144L, 144R extend over respective toothed pulleys 140L, 140R and, at one end, are attached, to the upper jaw 134U and, at their other end, are attached to the lower jaw 134L. Accordingly, by selectively retracting and extending the air cylinder 138, the upper and lower jaws 134U, 134L are simultaneously moved apart from one another and placed in their retracted position as shown in FIG. 21, and moved adjacent one another and placed in their extended position as shown in FIG. 22. As further described hereinbelow, jaws 134 are placed: in their extended position when severing a bag 14 from the roll 16 and when gripping the bag first and second walls 30, 32 for opening the bag; in their retracted position after the bag has been opened and the interior surface thereof has been gripped with fingers 122 for placing over the form tube rear edges 78E and on the form tube exterior surfaces 78; and, in an intermediate position when heat sealing and closing the bag 14.

Lower jaw 134L is provided with a guillotine knife 146 slidingly received within slot 148L. A plurality of air cylinders 150 are secured between the lower jaw 134L and the guillotine knife 146. The slot 148L extends through the flat contact surface 154L of the lower jaw 134L. Accordingly, by selectively extending the air cylinders 150, the guillotine knife 146 traverses upwardly thereby extending the knife cutting edge 152 thereof beyond the flat surface 154L of lower jaw 134L. The upper jaw 134U is also provided with a flat contact surface 154U and a slot 148U which extends through the flat contact surface 154U. When jaws 134U, 134L are placed in their extended position as shown in FIG. 22, the flat contact surfaces 154U, 154L are placed adjacent one another and the slots 148U, 148L are aligned with one another such that, when guillotine knife 146 traverses upwardly, the cutting edge 152 thereof traverses beyond both the flat surfaces 154U, 154L and into the slot 148U of the upper jaw 134U. Accordingly, bags 14, as further described hereinbelow, are cut from the roll 16 by sandwiching the upper and lower bag walls 30, 32 thereof between the flat contact surfaces 154U, 154L and extending cylinders 150 causing the guillotine knife edge 152 to extend, from the position shown in FIG. 23 to the position shown in FIG. 24, into the slot 148U of the upper jaw 134U and thereby cut through the bag walls 30, 32.

Figure 26:
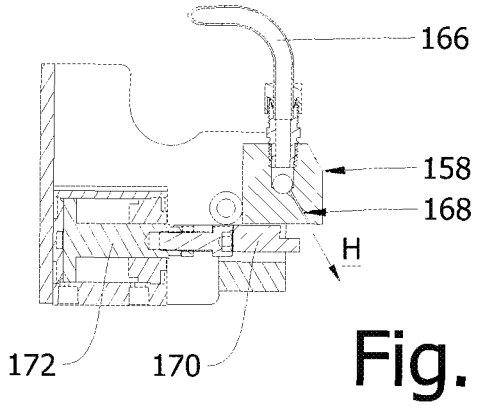
FIG. 26 is a cross-sectional view of the heat sealing assembly taken along line 26-26 in FIG. 21 and showing the press plate in its retracted position.
Figure 27:
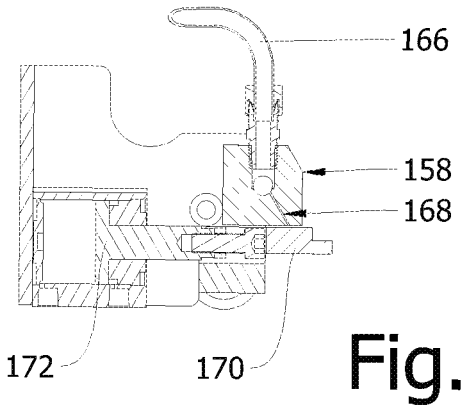
FIG. 27 is a cross-sectional view similar to FIG. 26 and showing the press plate in its extended position.
Figure 28:
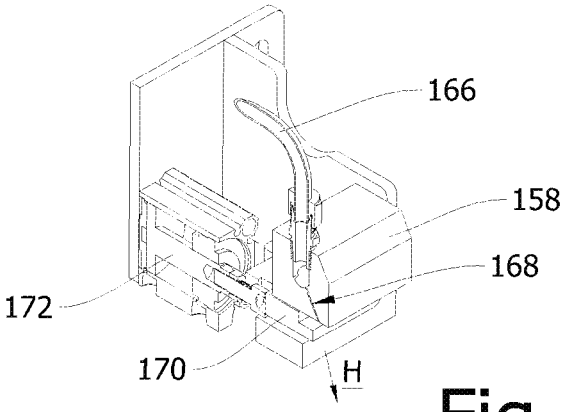
FIG. 28 is a perspective cross-sectional view taken along line 26-26 and showing the press plate in its retracted position.

Assembly 70 includes a heat sealing assembly 156 which is secured to and travels with the upper jaw 134U. As best seen in FIGS. 25-28, heat sealing assembly 156 includes a pair of manifolds 158 which are structurally and operationally the same. An air heating element 160 receives compressed air at its inlet 162 and delivers hot air through the T junction 164 and air lines 166 to each of the manifolds 158. As best seen in FIGS. 26-28, manifolds 158 are provided with a plurality of orifices 168 communicating with the air lines 166 for thereby directing hot air in a direction as indicated by arrow H.

Heat sealing assembly 156 also includes a pair of press plates 170, each of which are selectively slidable between a retracted position as shown in FIGS. 26 and 28 and an extended position as shown in FIG. 27. A pair of air cylinders 172 are provided, each of which are secured between the heat sealing assembly 156 and one of the press plates 170, for thereby selectively extending and retracting the press plates 170. As further described hereinbelow, when closing and heat sealing a bags 14, hot air is provided through the manifolds 158 and directed through the orifices 168 to the polypropylene bag material several overlap layers for thereby partially melting the several layers and, thereafter, the press plates 170 are extended and placed in contact with the partially melted polypropylene thereby fusing the several layers together.

Figure 29:
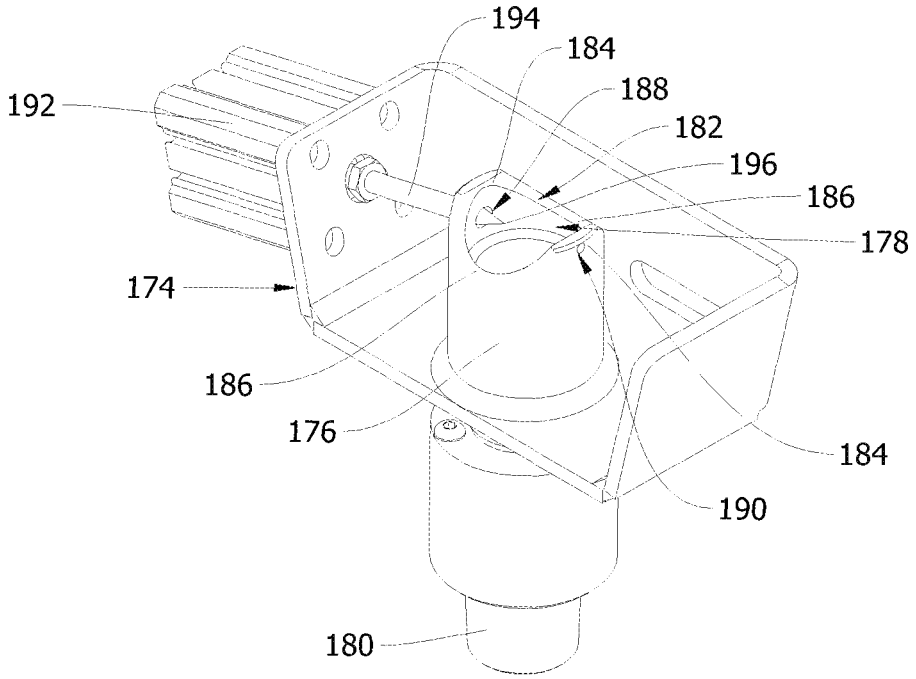
FIG. 29 is a perspective view of the vacuum and grip pin assemblies which are carried on the upper and lower jaws of the assembly shown in FIG. 21 and showing the grip pin in its retracted position.
Figure 30:
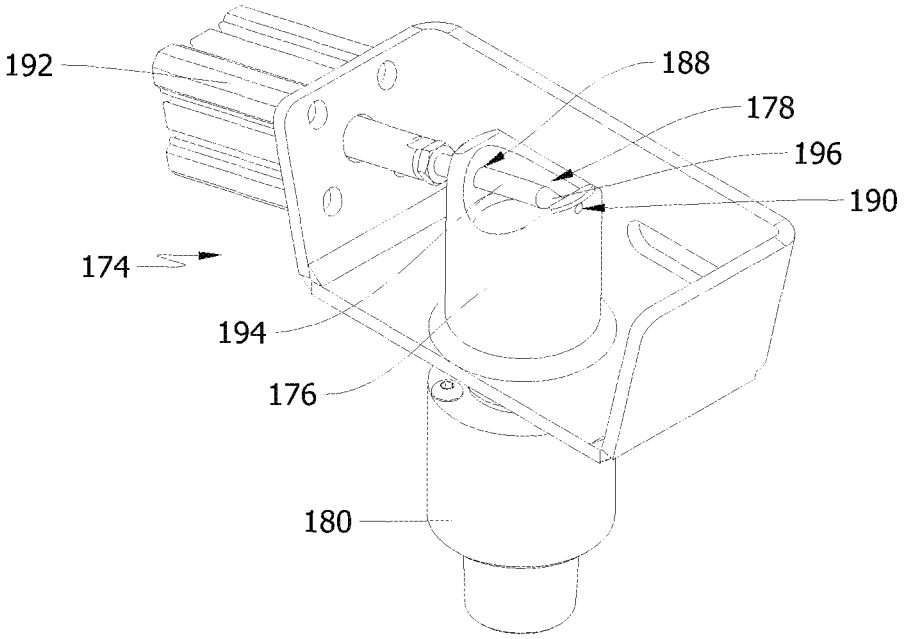
FIG. 30 is a perspective view similar to FIG. 29 and showing the grip pin in its extended position.
Figure 31:
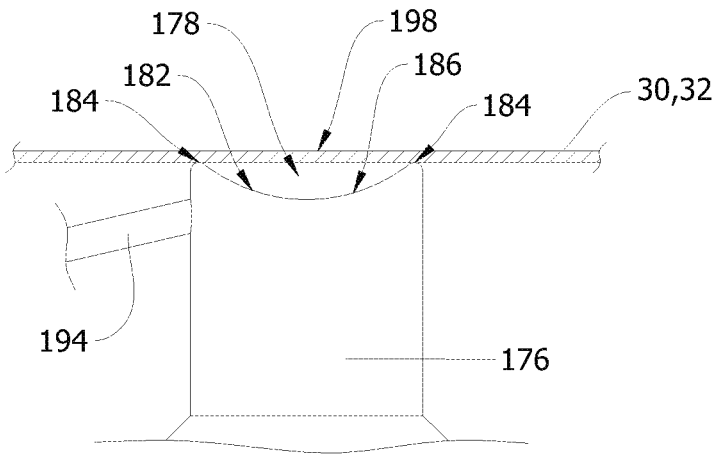
FIG. 31 is a side elevation view of the vacuum coupling and grip pin of the assembly shown in FIG. 29 and showing a bag wall in cross-section prior to application of the vacuum and extension of the grip pin.
Figure 32:
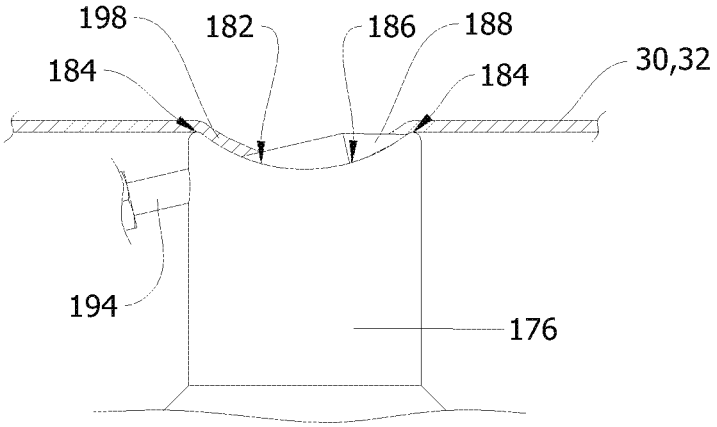
FIG. 32 is a side elevation view similar to FIG. 31 and showing the bag wall in cross-section after application of the vacuum and extension of the grip pin.

Assembly 70 also includes left and right vacuum and grip pin assemblies 174LU, 174RU which are secured to and travel with the upper jaw 134U and left and right vacuum and grip pin assemblies 174LL, 174RL which are secured to and travel with the lower jaw 134L. Each of the vacuum and grip pin assemblies 174 are structurally and operationally the same. Referring more particularly to FIGS. 29-32, vacuum and grip pin assemblies 174 include a vacuum coupling 176 comprising a vacuum inlet opening 178 communicating with a hose 180 which is connected to a vacuum source (not shown). The vacuum inlet opening 178 includes a rim 182 which is essentially saddle shaped having transversely aligned raised sides 184 and longitudinally aligned lowered sides 186. An aperture 188 is provided through the vacuum coupling 176 generally below one of the raised sides 184 and is aligned with a depression 190 extending into the rim at the other one of the raised sides 184. An air cylinder 192 is mounted to the vacuum and grip pin assembly 174 and includes a grip pin 194 having a sharp terminal end 196. Accordingly, by selectively extending the air cylinder 192, the grip pin 194 can selectively be extended through the aperture 188 placing the sharp terminal end 196 thereof in the depression 190 as shown in FIGS. 30 and 32. By selectively retracting the air cylinder 192, the grip pin 194 can be selectively retracted removing the sharp terminal end 196 from the depression 190 and retracting the grip pin 194 from within the vacuum coupling 176 as shown in FIGS. 29 and 31.

As further described hereinbelow, after severing a bag 14 from the roll 16, the vacuum and grip pin assemblies 174 draw up and securely hold the bag walls 30, 32 so that the upper and lower jaws 134U, 134L can be retracted to their position shown in FIG. 21 thereby separating the bag walls 30, 32 from one another and effectively opening the bag 14 and readying the bag opening for receiving the fingers 122 therein. In this regard, as shown in FIGS. 31 and 32, the inlet openings 178 of the vacuum and grip pin assemblies 174 are first placed in close proximity to a bag wall 30, 32 as shown in FIG. 31. A vacuum is then provided via hose 180 at the coupling inlet opening 178 thereby drawing a portion 198 of the bag wall 30, 32 onto the rim 182 and partially within the coupling 176. The air cylinder 192 is then extended thereby also extending the grip pin 194 through the aperture 188, piercing through the portion 198 of the bag wall 30, 32 and locating the grip pin terminal end 196 in the depression 190. Accordingly, with the grip pin 194 pierced/extending through the portion 198, each of the bag walls 30, 32 are securely retained for pulling the bag walls 30, 32 apart and opening the bag 14 as needed. After the fingers 122 have been inserted into the open bag and are frictionally engaged with the interior surface thereof, the bag walls 30, 32 are released from the vacuum and grip pin assemblies 174 by removing the vacuum and retracting the grip pin 194 from the inlet opening 178 and releasing the portion 198 of the back walls 30, 32.

Figure 34:
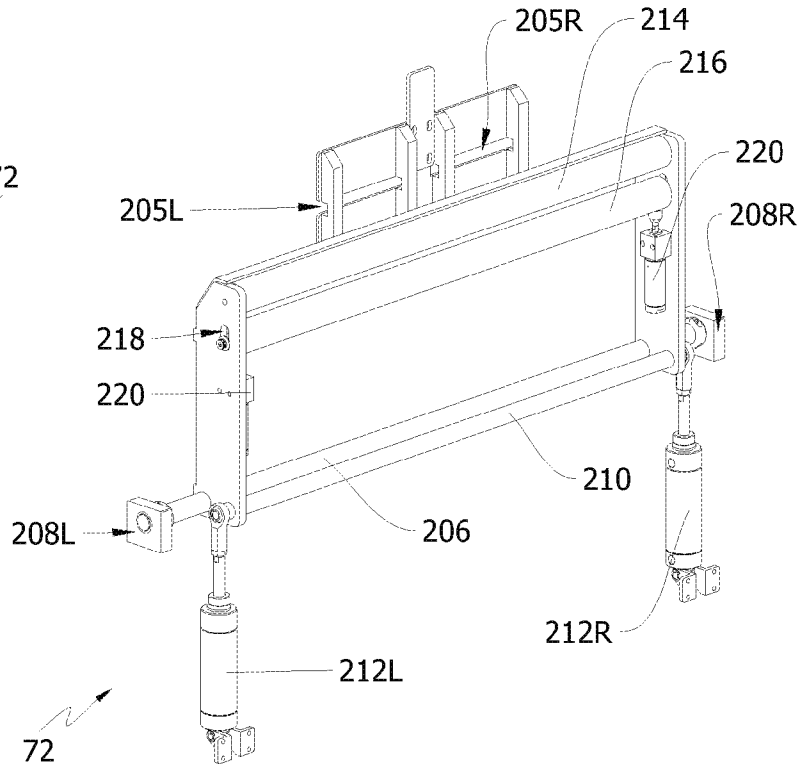
FIG. 34 is a perspective view of the bottom fold plate assembly similar to FIG. 33 and showing the bottom fold plate assembly in its vertically extended position.
Figure 33:
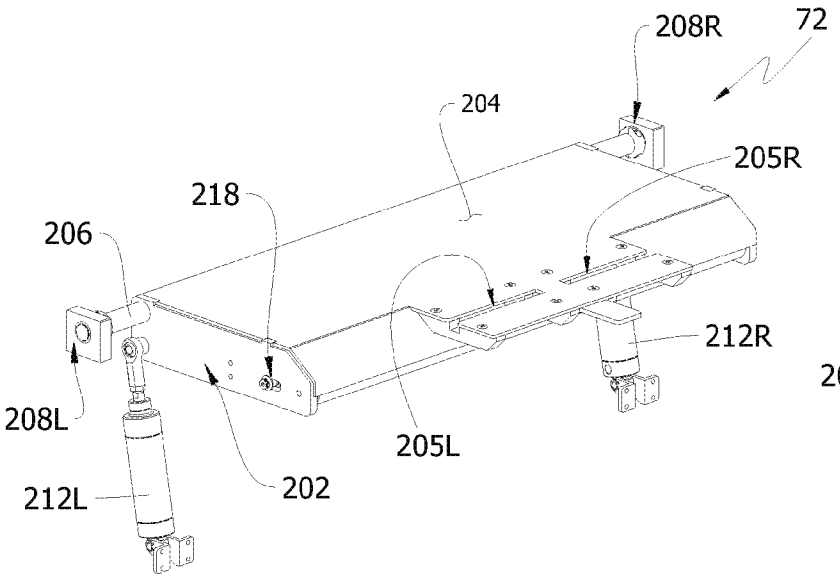
FIG. 33 is a perspective view of the bottom fold plate assembly which is part of the assembly shown in FIG. 12 and showing the bottom fold plate assembly in its lowered position.
Figure 45:
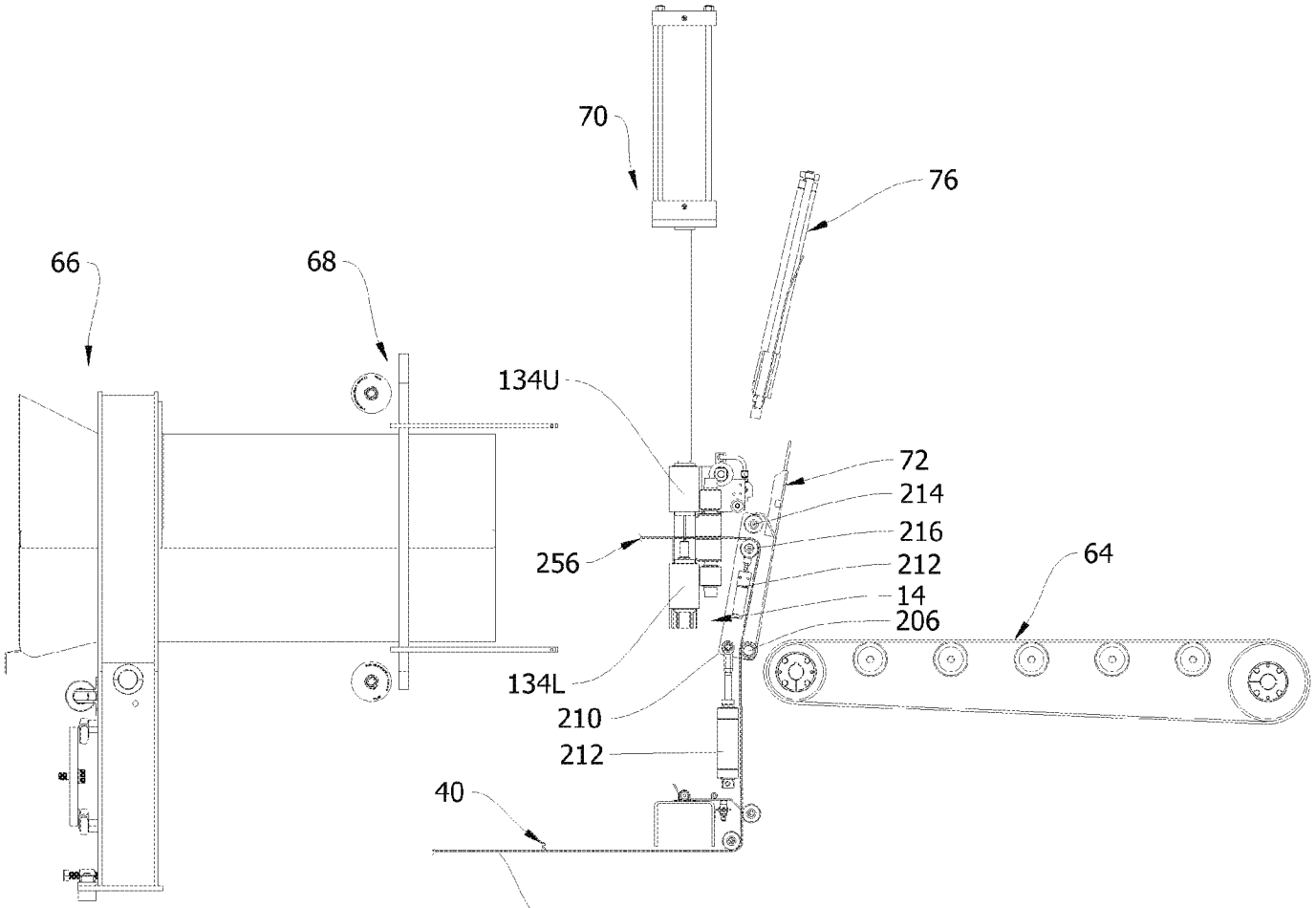
Figure 46:
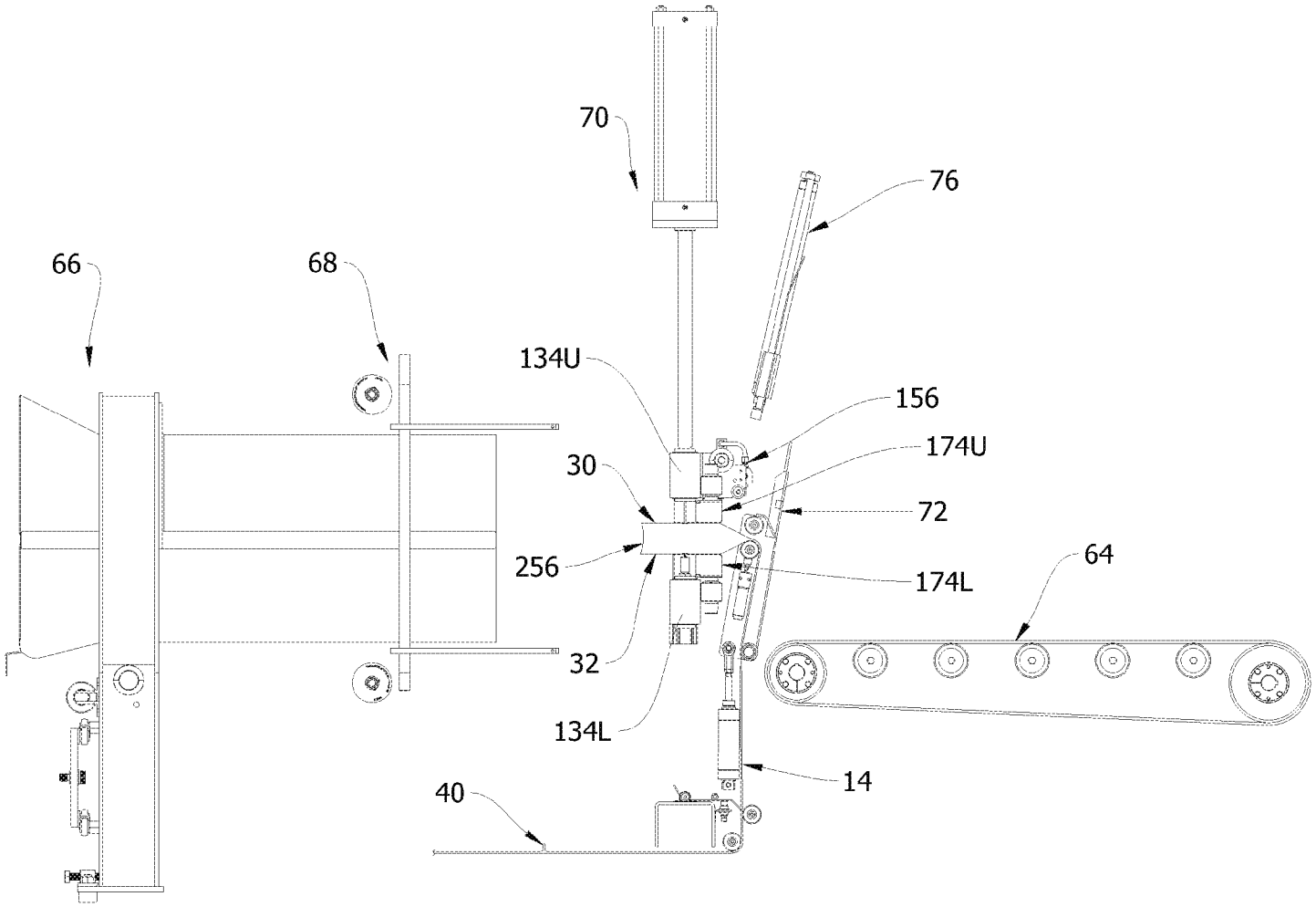

The bottom fold plate assembly 72: provides a transition surface between the form tube 66 and the output conveyor 64; guides the bag 14 as it is collected onto the form tube 66; pinches and holds the next bag as the prior bag which has been collected onto the form tube 66 is severed therefrom; folds the bottom closure flap onto the bale 12; and, provides guide slots 205 for the slack bars 200. Bottom fold plate assembly 72 includes a plate assembly 202 comprising a plate surface 204. Plate assembly 202 is supported on the frame 53 via a transverse pivot shaft 206 which is pivotally secured to the frame 53 at its terminal ends 208L, 208R. A roller shaft 210 is pivotally secured to the plate assembly 202 adjacent to and parallel with the transverse pivot shaft 206. Air cylinders 212L, 212R are pivotally secured between the frame 53 and the respective terminal ends of the roller shaft 210. Accordingly, by selectively extending and retracting the air cylinders 212L, 212R the plate assembly 202 can selectively be pivoted to a lowered horizontal position as shown in FIG. 33, a vertical extended position as shown in FIG. 34, an intermediate position between the lowered horizontal and the vertical extended positions, and an angled position as shown in FIG. 45.

Figure 42:
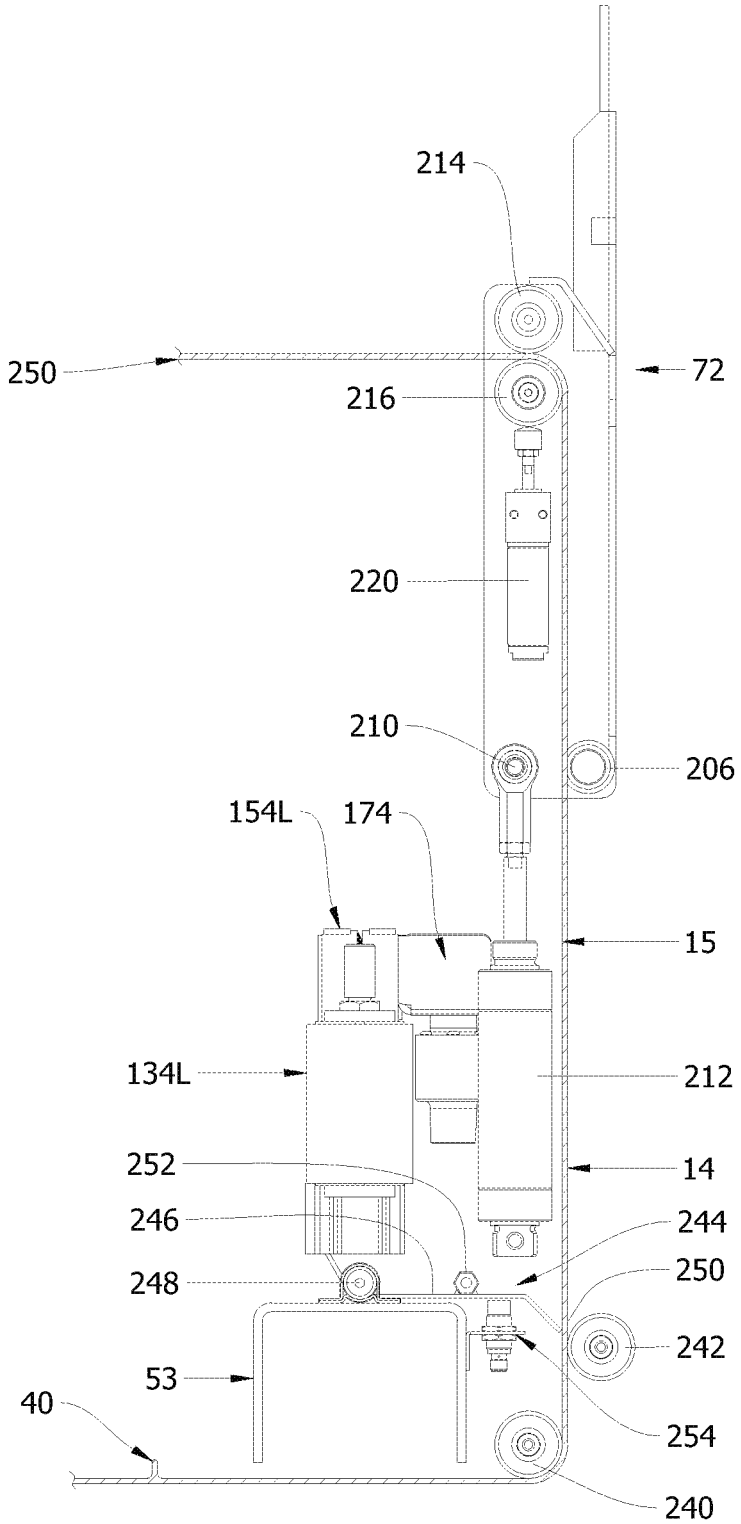
FIG. 42 is a side elevation view of the seam sensor assemblies and the bottom fold plate assembly and showing the web of bags in its initial position for initiating the bale wrappings process.
Figure 43:
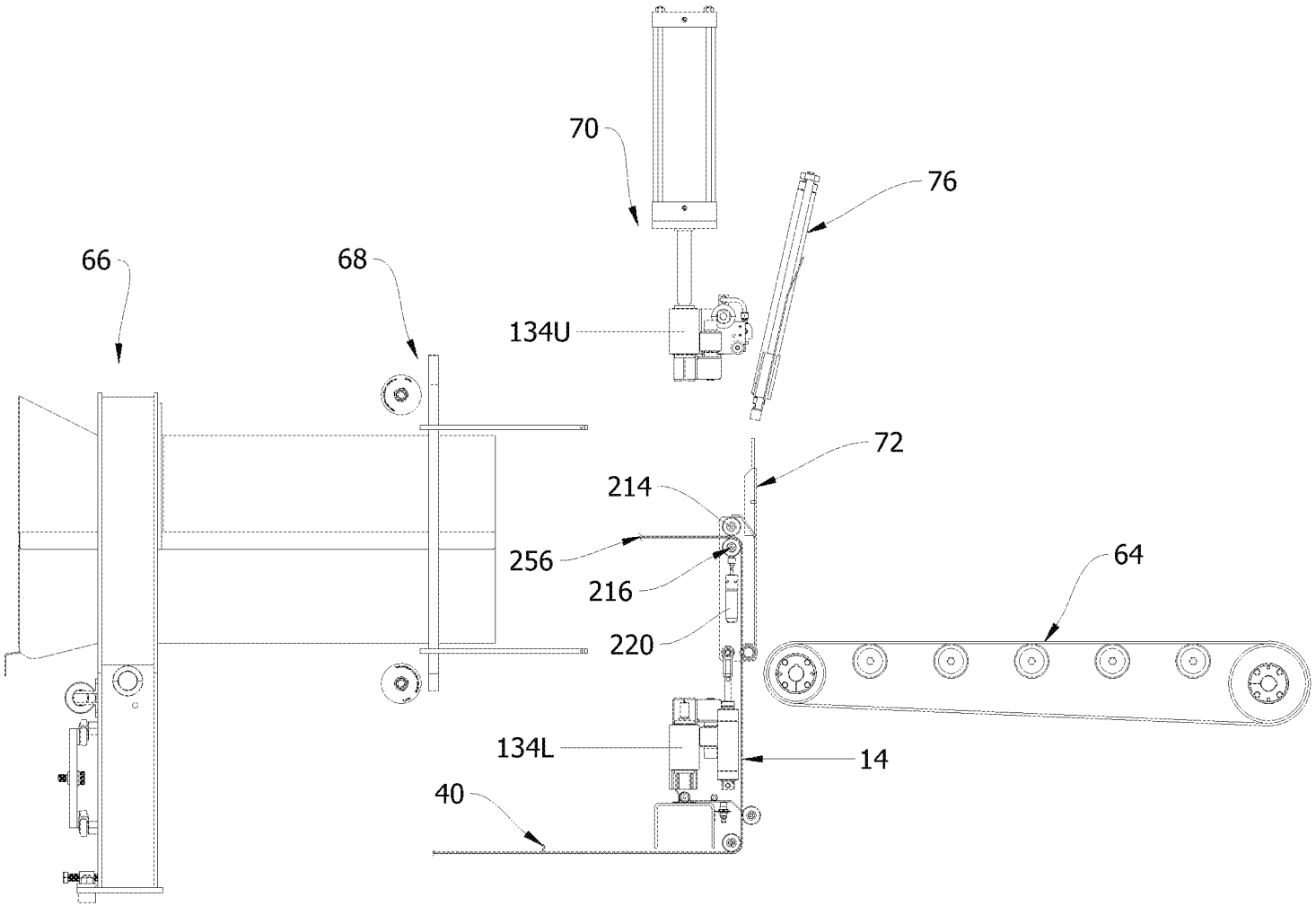
FIGS. 43-53 are diagrammatic side elevation views of the apparatus depicting the process of severing a bag from a continuous web/roll, opening and placing the bag on a form tube and inserting a bale through the form tube and into the bag for thereby enveloping the bale.

First and second parallel transverse guide rollers 214, 216 are pivotally carried on the plate assembly 202 and are adapted to receive the closed, preformed end-to-end bags 14 therebetween. Second guide roller 216 is pivotally secured at its terminal ends in slots 218 and is thereby selectively movable between first position and second positions. In its first position, roller 216 is in contact with the first guide roller 214 as shown in FIGS. 42 and 43 whereby the bags 14 are pinched and retained therebetween. As shown in FIGS. 45-51, in its second position, roller 216 is spaced from the first guide roller 214 a distance sufficient to allow the bags 14 to freely travel therebetween. Air cylinders 220 are secured to the plate assembly 202 and are adapted to selectively push against the second roller 216 in the direction of slots 218 for thereby selectively pushing the second roller 216 to its first position and simultaneously preventing rotation thereof and preventing the bags 14 from traveling thereover. When air cylinders 220 are retracted, the second roller 216 moves away from the first roller 214 and to its second position whereat it is free to rotate and allow the bags 14 to freely travel thereover.

As mentioned hereinabove, left and right guide slots 205L, 205R are provided on the plate surface 204 whereat the slack bars 200L, 200R which are carried on the side fold assembly 72 can be received. It is noted that, when closing the bag 14, the several bag closure flap layers extend around the slack bars 200L, 200R and into the respective guide slots 205L, 205R thereby creating slack/providing additional polypropylene material within the slots 205L, 205R such that it can be partially melted for fusing and sealing the closure flaps.

Figure 36:
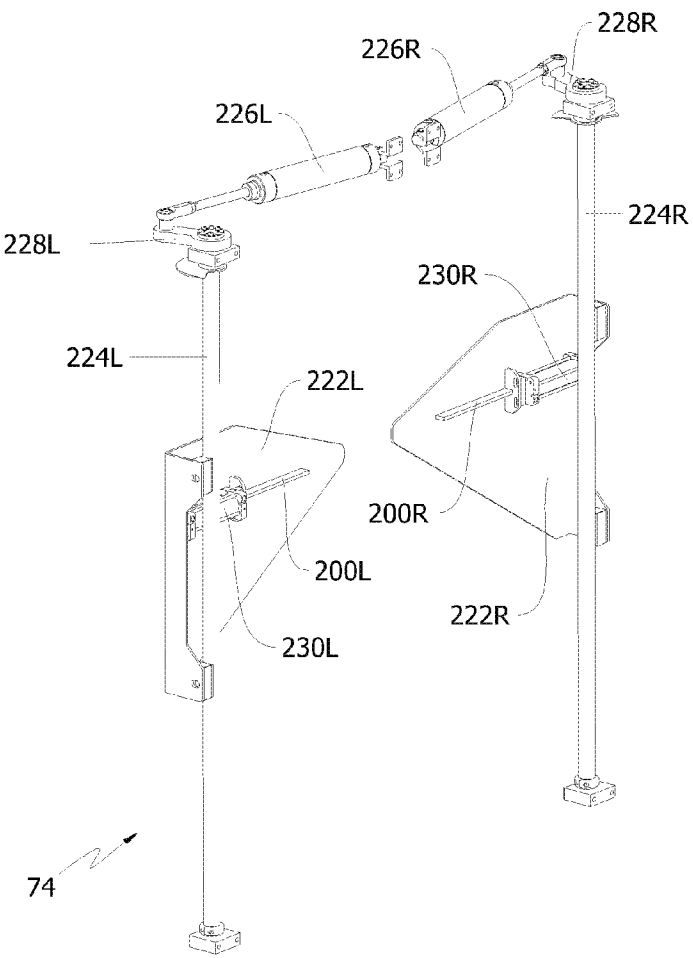
FIG. 36 is a perspective view of the side fold assembly shown in FIG. 35 and showing the side flaps in a second position and showing the slack bars in their retracted position.
Figure 35:
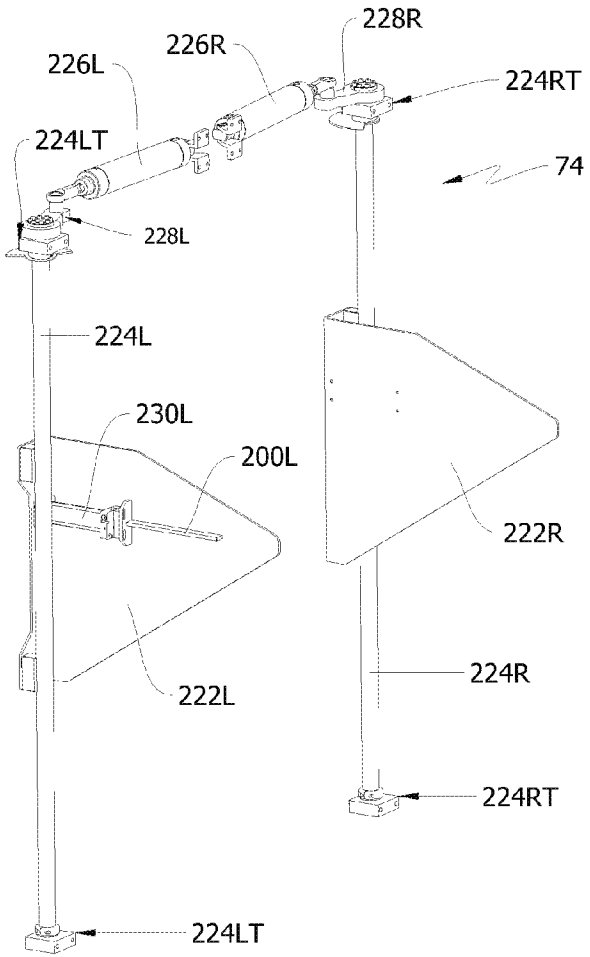
FIG. 35 is a perspective view of the side fold assembly which is part of the assembly shown in FIG. 12 and showing the side flaps in a first position.
Figure 37:
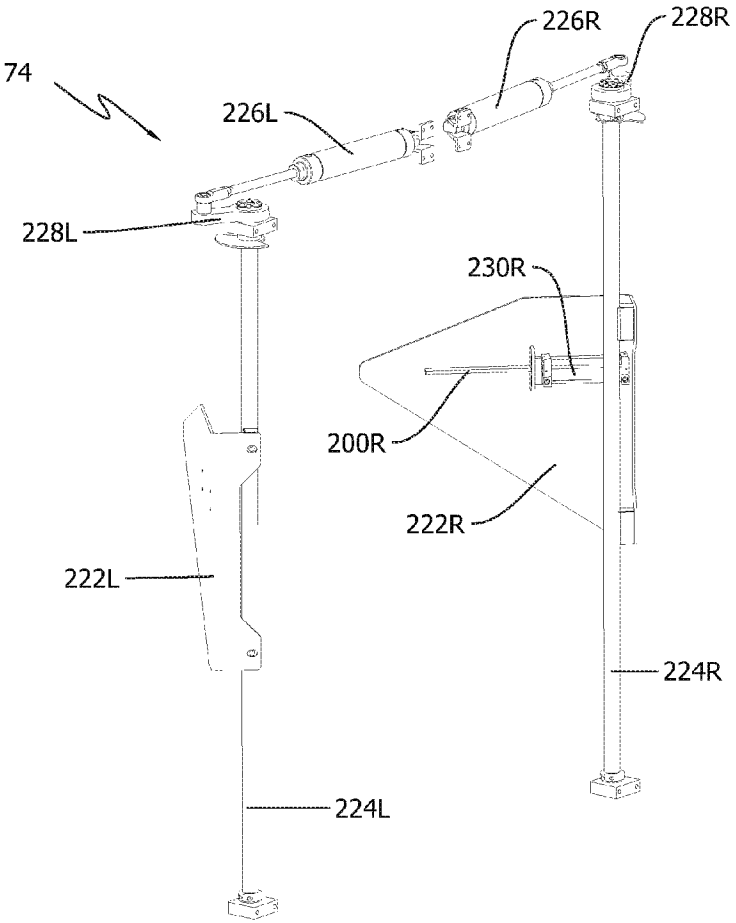
FIG. 37 is a perspective view of the side fold assembly shown in FIG. 35 and showing the side flaps in a third position.

Referring now more particularly to FIGS. 35-38, the side fold assembly 72 includes left and right side flaps 222L, 222R which, as further described hereinbelow, fold the left and right closure flap portions of the bag when closing the bag after the bottom closure flap has been folded up and prior to the top closure flap being folded down. Left and right side flaps 222L, 222R are secured on and rotate with respective left and right vertical shafts 224L, 224R. Vertical shafts 224L, 224R are pivotally secured at their terminal ends 224LT, 224RT to the frame 53 (not shown). Left and right pivot arms 228L, 228R are secured to and extend from the respective vertical shafts 224L, 224R. Air cylinders 226L, 226R are pivotally connected between the frame 53 and the respective pivot arms 228L, 228R whereby, by extending and retracting the air cylinders 226L, 226R, the left and right side flaps 222L, 222R are selectively rotated about their respective left and right vertical shafts 224L, 224R and placed in several positions including those shown in FIGS. 35-37. In FIG. 35 the side flaps 222L, 222R are shown in a first position wherein they are longitudinally aligned and point toward the forming tube 66. In FIG. 36 the side flaps 222L, 222R are shown in a second position wherein they are situated transversely/perpendicular to the longitudinal travel of bales 12. In FIG. 37 the side flaps 222L, 222R are shown in a third position pointing at an angle generally toward the conveyor 64. Side flaps 222L, 222R are located in the third position as the enveloped bale 12 exits the assembly 52 and travels along the output conveyor 64 so that the side flaps 222L, 222R can be removed from the overlapped closure flaps of the bag.

Figure 38:
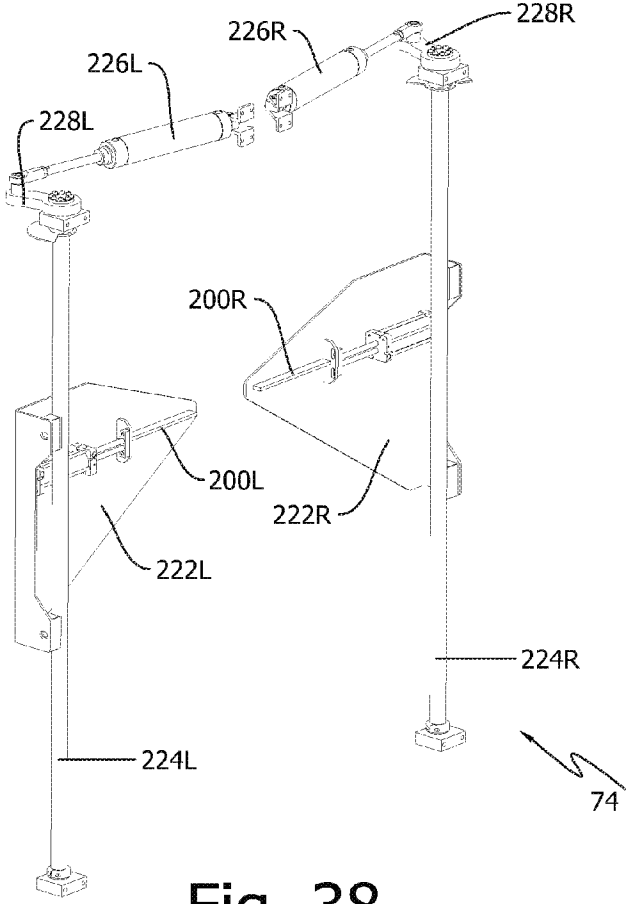
FIG. 38 is a perspective view of the side fold assembly shown in FIG. 36 and showing the slack bars in their extended position.

As also mentioned hereinabove, slack bars 200L, 200R are carried on the side fold assembly 72. More particularly, slack bars 200L, 200R are attached to the piston of respective air cylinders 230L, 230R which are themselves secured to the respective side flaps 222L, 222R. Accordingly, by selectively retracting and extending the air cylinders 230L, 230R, the slack bars 200L, 200R can be selectively retracted as shown in FIG. 36 and extended as shown in FIG. 38.

Figure 40:
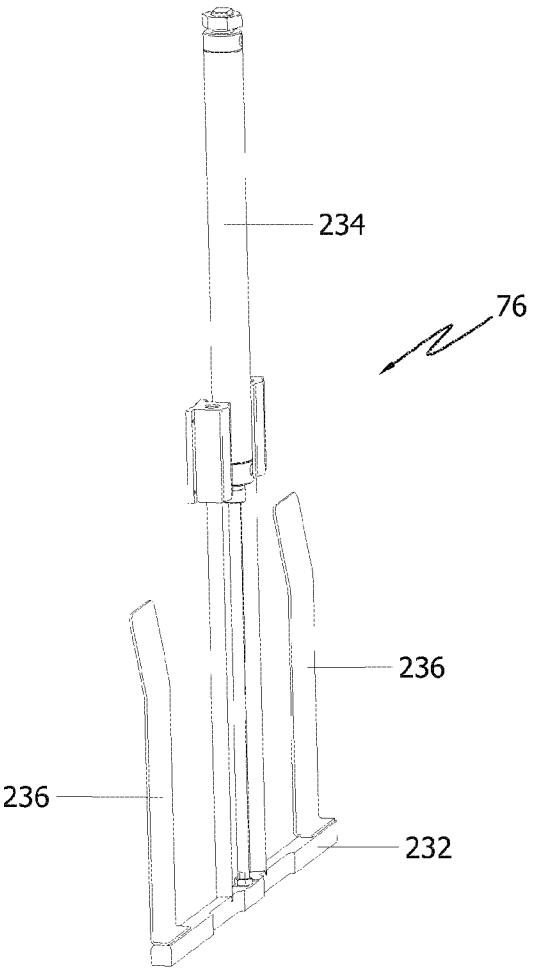
FIG. 40 is a perspective view of the top fold assembly similar to FIG. 39 and showing the top fold bar in its extended position.
Figure 39:
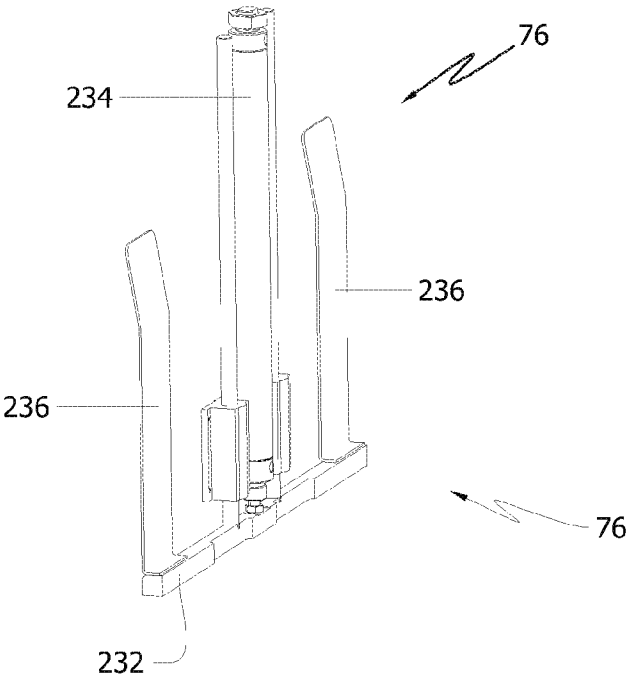
FIG. 39 is a perspective view of the top fold assembly which is part of the assembly shown in FIG. 12 and showing the top fold bar in its retracted position.

The top fold assembly 76 folds down the bag top closure flap after the side closure flaps have been folded in and prior to heat sealing. Top fold assembly 76, as also shown in FIGS. 39 and 40, comprises a top fold bar 232 which is secured to the piston of air cylinder 234. A pair of tail extensions 236 are secured to and extend generally perpendicular from the top fold bar 232. Air cylinder 234 is secured to the frame 53 and, by selectively retracting and extending the piston thereof, top fold bar 232 can be retracted as shown in FIG. 39 and extended as shown in FIG. 40.

Figure 41:
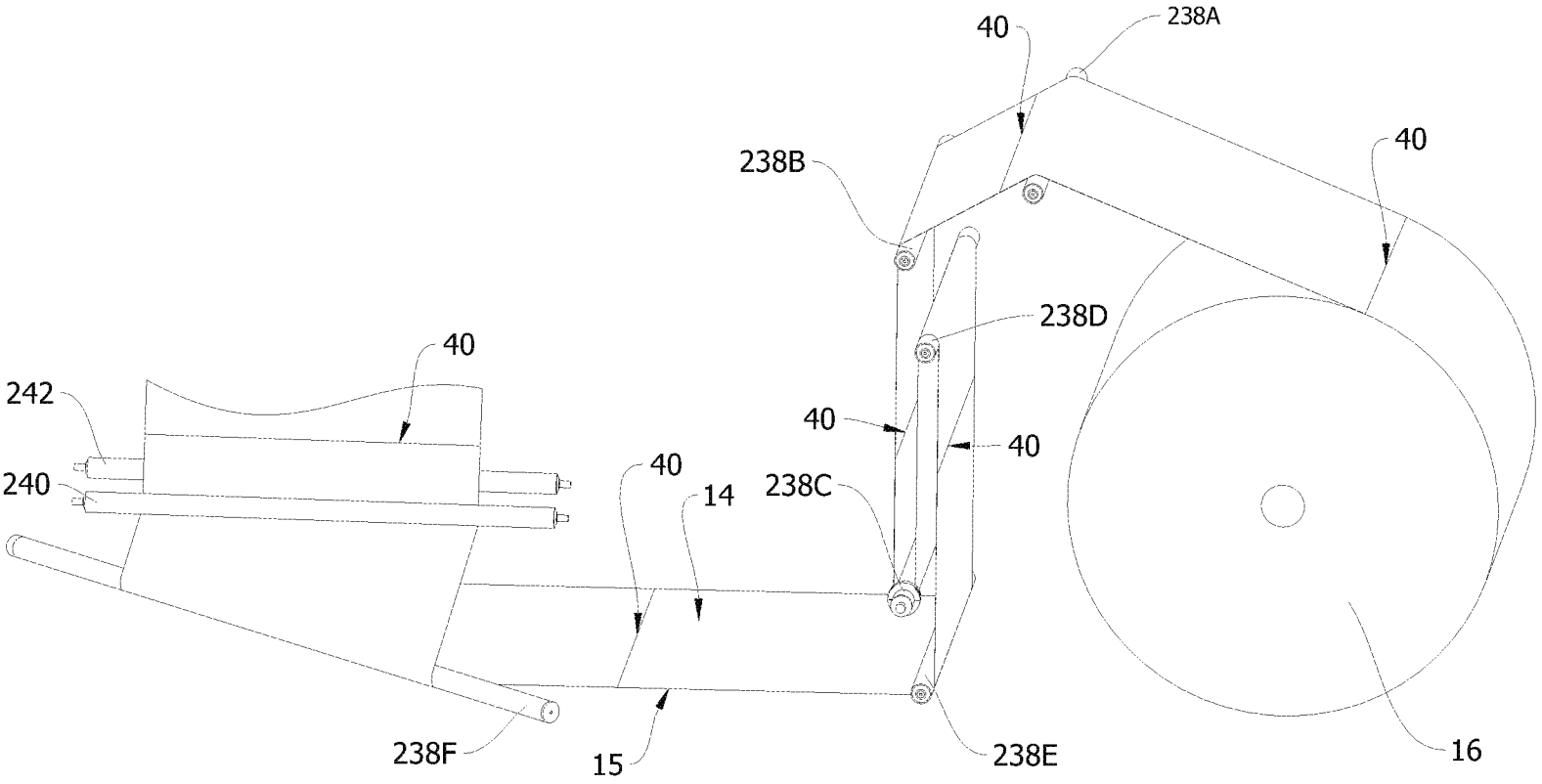
FIG. 41 is a diagrammatic perspective view of the web of closed, preformed end-to-end bags being unrolled from a roll and presented to the enveloping apparatus.

As mentioned hereinabove, apparatus 10 employs a plurality of closed, preformed end-to-end bags 14 provided as a continuous elongate web 15 on a roll 16 for enveloping the bales 12. As shown in FIGS. 1, 2 and 41, the continuous elongate web 15 of bags 14 is unrolled from a roll 16 and travels over a plurality of web rollers 238A-238F and under the apparatus 10 whereat it is presented to the assembly 52 between web supply rollers 240, 242.

Figure 11:
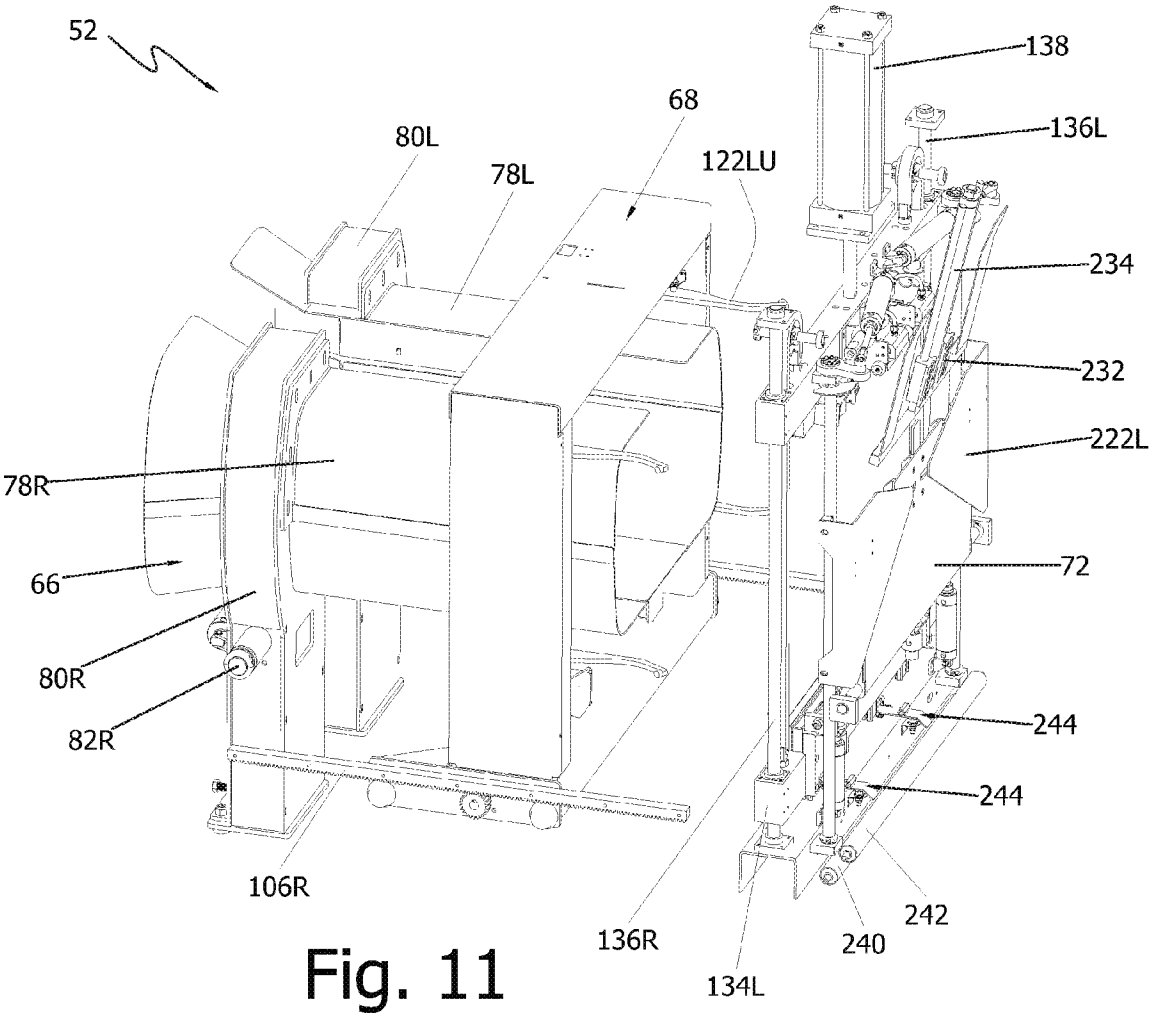
FIG. 11 is another perspective view of the assembly shown in FIG. 10.
Figure 12:
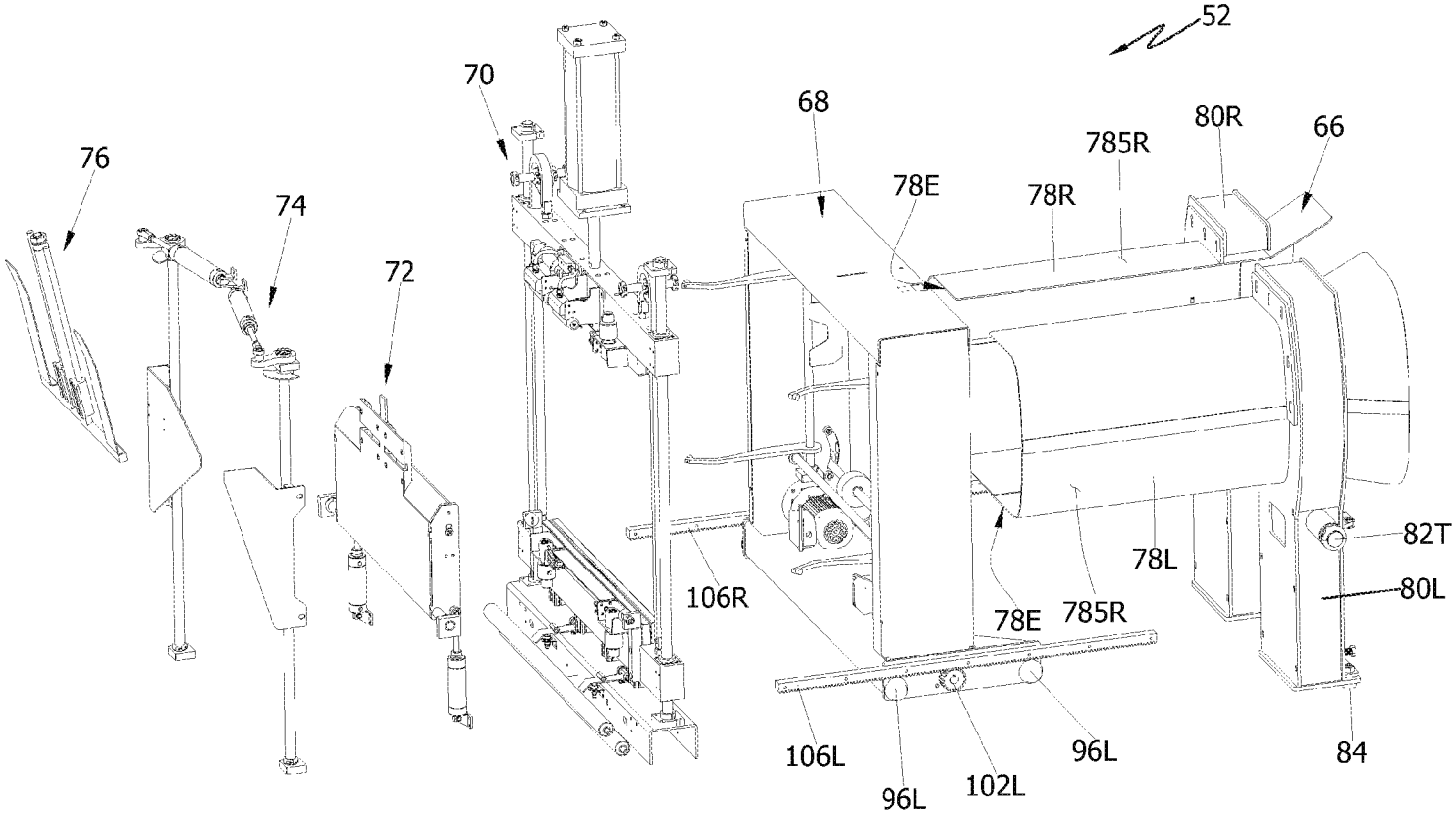
FIG. 12 is an exploded perspective view of the assembly shown in FIG. 10 showing the several components thereof.
Figure 13:
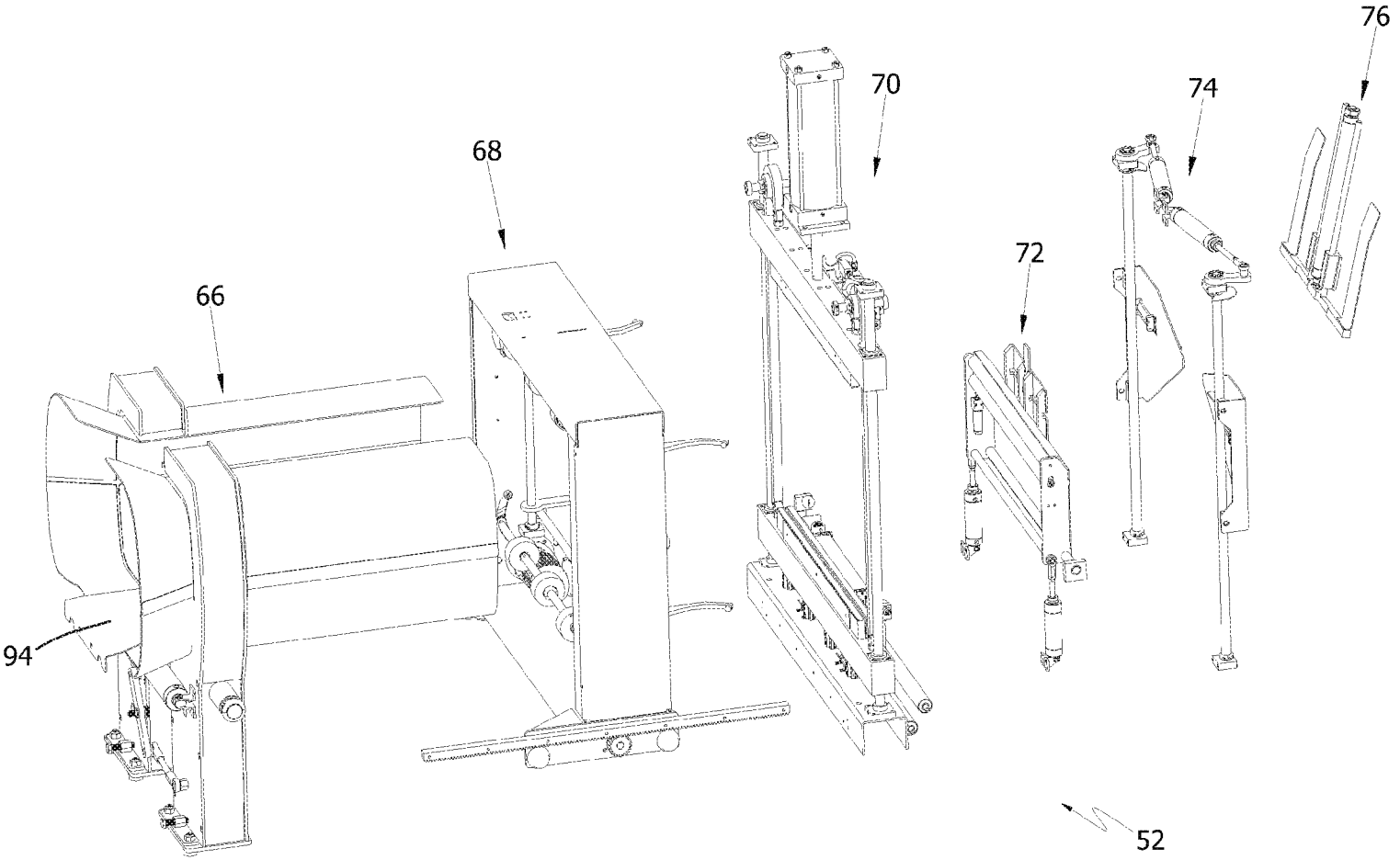
FIG. 13 is another exploded perspective view of the assembly shown in FIG. 10 and showing the several components thereof.

A pair of seam sensor assemblies 244, as best seen in FIGS. 11, 12, and 42, are mounted to the frame 53 adjacent and above the web supply rollers 240, 242 and are located adjacent the web 15. Seam sensor assemblies 244 include sensor arms 246 which are pivotally secured to the frame 53 at pivot joint 248 and which include terminal smooth ends 250. Sensor arms 246 rest on proximity sensors 254 and a weight 252 is provided on the arms for normally maintaining them on the sensors 254. Sensor arms 246 extend from their pivot joint 248 toward the web 15. The terminal ends 250 thereof are located adjacent to and normally not in contact with the web 15 except that, as seam lines 40 travel thereover, arms 46 are caused to pivot upwardly thereby temporarily lifting them from their proximity sensor 254 and thereby providing a locating control signal to the apparatus 10. As can be appreciated, the seam line 40 locating control signal is used by apparatus 10 for locating the web 15 as needed and severing each bag 14 therefrom.

Although other types of seam sensors can be provided, the seam sensor assemblies 244 are economical and function reliably with the bags 14. The seams 40 include U-shaped sewn projections as shown in FIGS. 8 and 9 which project from the bag side walls 30, 32 and which reliably lift the sensor arms 246 as the seams 40 travel adjacent the sensor terminal ends 250. Also, by providing two transversely situated sensor assemblies 244 as shown in FIGS. 11 and 12, a false signal, such as when only one of the sensor arms 246 is lifted by a helix seam 29, can be avoided.

The operation of apparatus 10 and method of enveloping the bales 12 within bags 14 is further shown and described with reference to FIGS. 43-59 wherein only the apparatus components which come in contact with the web 15 are shown for clarity purposes. FIG. 43 shows the web 15 in its initial position (at the beginning of a bag opening, bale insertion and bag closing cycle) and ready for initiating the bale enveloping process. Here, a bag 14 is shown which has been severed from another bag at transverse sever line 256 (see also FIG. 6) and wherein the bag upper and lower walls 30, 32 are adjacent one another/not separated and the bag is not yet opened. Here, the air cylinders 220 are extended thereby pushing the second guide roller 216 against the first guide roller 214 and pinching and retaining the bag 14 therebetween and in the position as shown.

Figure 44:
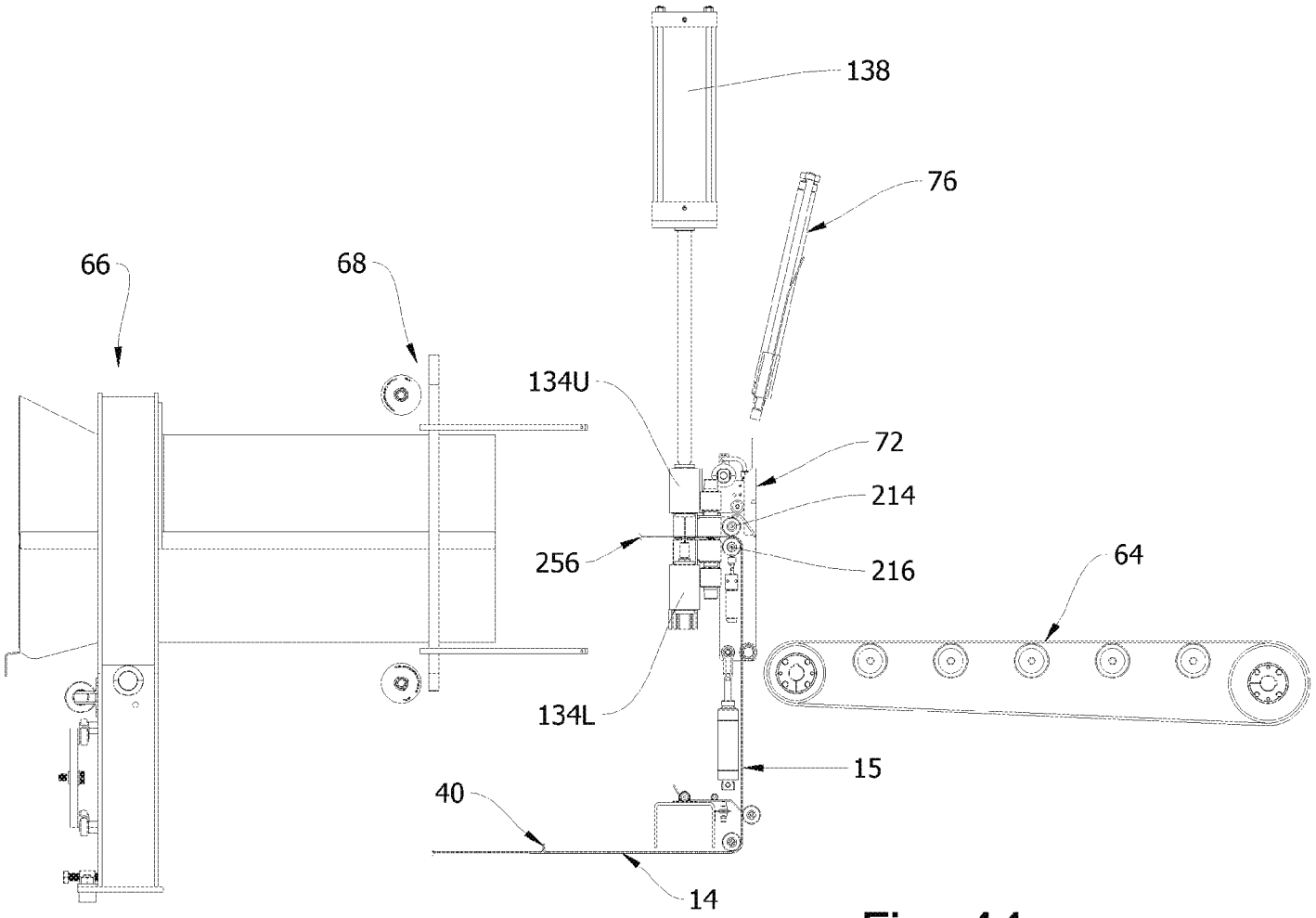

As shown in FIG. 44, air cylinder 138 is then extended and the upper and lower jaws 134U, 134L are moved to their extended positions whereat the bag 14 portion adjacent the sever line 256 is sandwiched therebetween. That is, bag 14 is sandwiched and retained between the upper and lower contact surfaces 154U, 154L of the upper and lower jaws 134U, 134L. In this position, a vacuum can also be provided to the vacuum inlet openings 178 of the vacuum and grip pin assemblies 174.

As shown in FIG. 45, the air cylinders 220 are then retracted thereby moving the second guide roller 216 away from the first guide roller 214 and releasing the bag 14 from therebetween. In this position, guide roller 216 freely rotates and the bag 14 can freely travel thereover, between guide rollers 214 and 216. Air cylinders 212L, 212R are then partially extended causing the plate assembly 202 to pivot about the pivot shaft 206 toward the output conveyor 64 to an angled position as shown.

A vacuum is then provided at all four of the vacuum and grip pin assemblies 174 such that the back wall portions 198 of the first bag wall 30 are drawn into the inlet openings 178 of the vacuum and grip pin assemblies 174LU and 174RU on the upper jaw 134U, and the back wall portions 198 of the second bag wall 32 are drawn into the inlet openings 178 of the vacuum and grip pin assemblies 174LL and 174RL on the lower jaw 134L. The grip pins 194 are then extended or, more preferably, the upper and lower jaws 134U, 134L are partially refracted as shown and, thereafter, the grip pins 194 are extended for thereby securely holding the first bag wall 30 on the upper jaw 134U via the vacuum and grip pin assemblies 174LU and 174RU thereon and securely holding the second bag wall 32 on the lower jaw 134L via the vacuum and grip pin assemblies 174LL and 174RL thereon.

Figure 47:
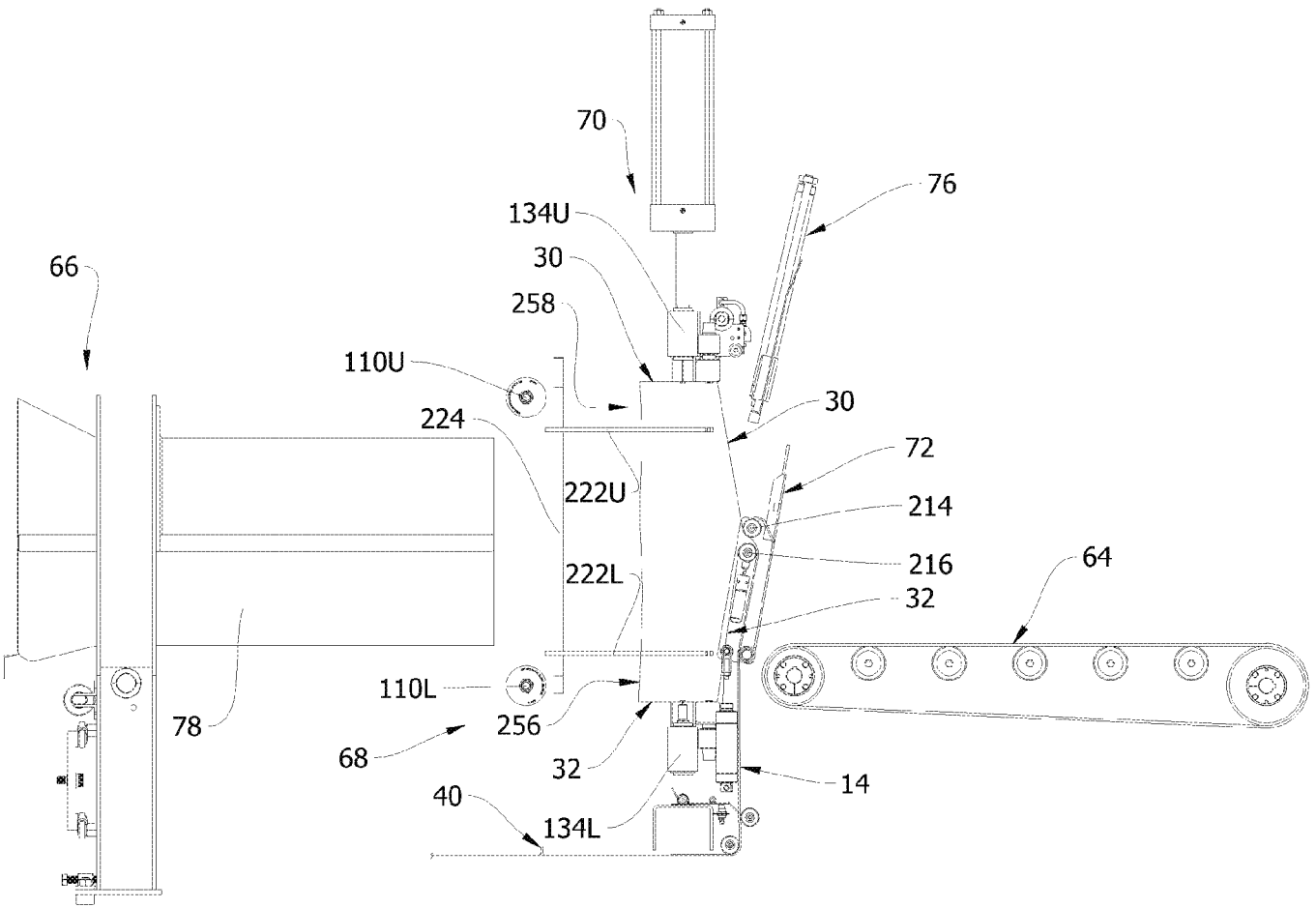

As shown in FIG. 47, the upper and lower jaws 134U, 134L are then further retracted for thereby fully opening the bag 14. The grip fingers 122 of the bag placer assembly 68 are then retracted as depicted in FIG. 20 and the bag placer assembly 68 is longitudinally traversed for placing the retracted grip fingers 122 into the bag opening 258 as shown. The grip fingers 122 are then extended as depicted in FIG. 19 such that the rubber tips 124 thereof frictionally engage the interior surface of the bag 14.

Figure 48:
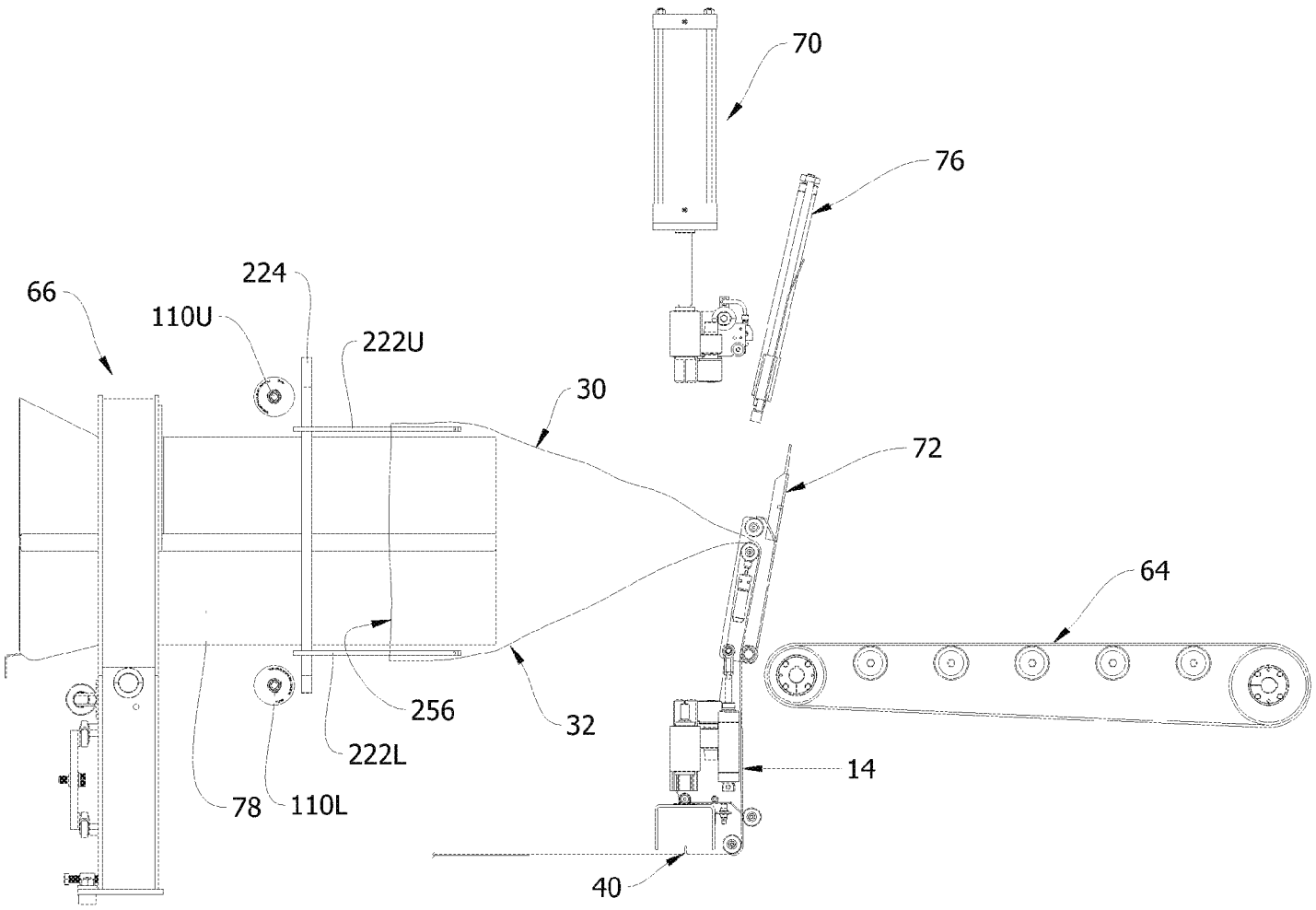

The bag placer assembly 68 is then longitudinally traversed toward the form tube 66 thereby causing the form tube rear end to be inserted within the bag opening 258 as shown in FIG. 48 (the bag open end 258 is placed on to the rear end of the form tube 66). As should be appreciated, as the bag placer assembly 68 is longitudinally traversed, the bag 14 is pulled through the bottom fold plate assembly 72 and ultimately from the roll 16.

Figure 49:
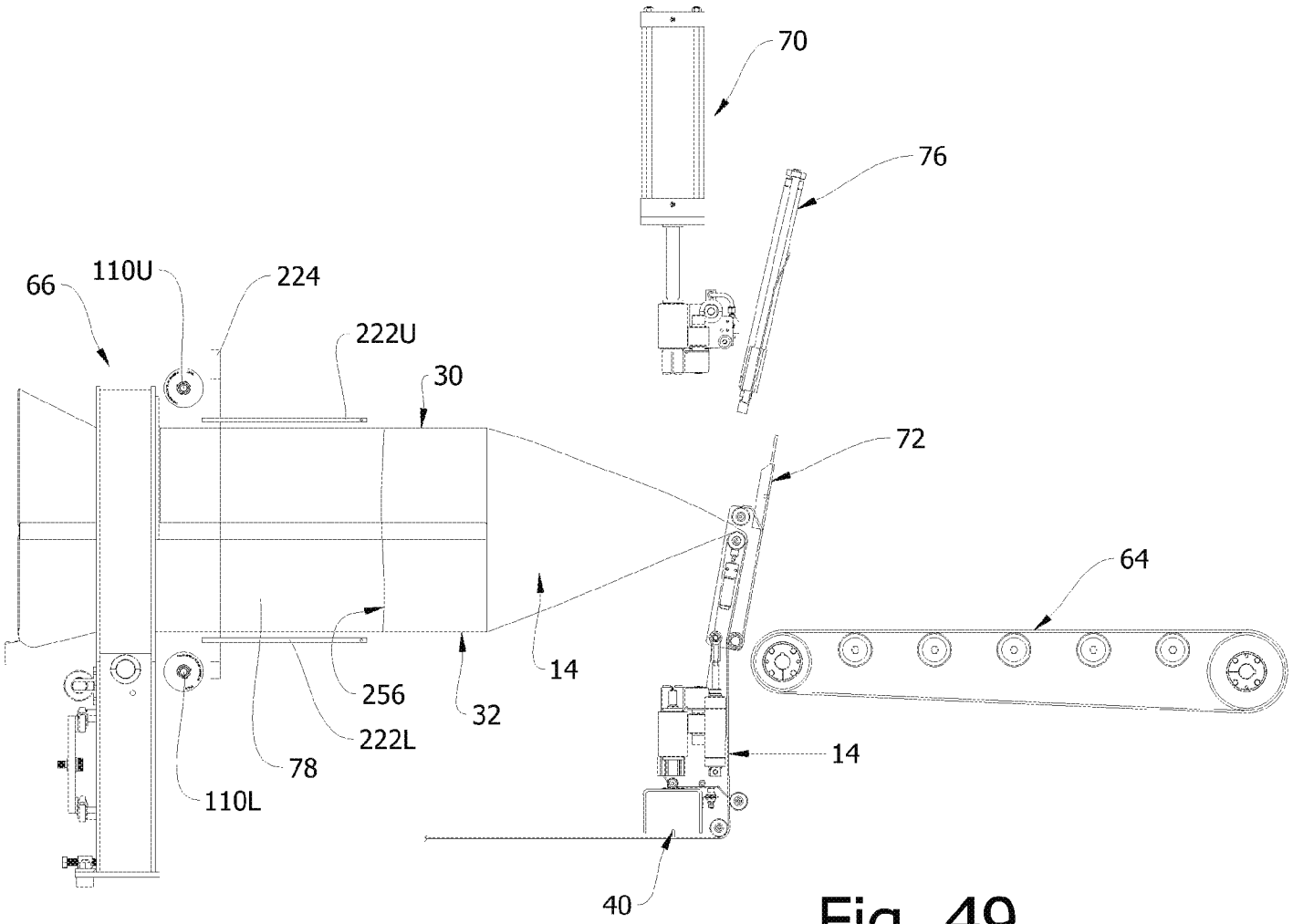

The grip fingers 122 are then again retracted disengaging the finger rubber tips 124 from the interior surface of the bag 14 and the bag placer assembly is further traversed longitudinally toward the form tube inlet end/front flared surface 78F thereby removing the fingers from within the bag 14 as shown in FIG. 49. In this position, the form tube rear end remains inserted within the bag opening 258. As also depicted in FIG. 49, the form tube 66 is then placed in its expanded position as shown in FIG. 14 thereby creating a snug/close fit between the form tube 66 and the interior surface of the bag 14.

Figure 50:
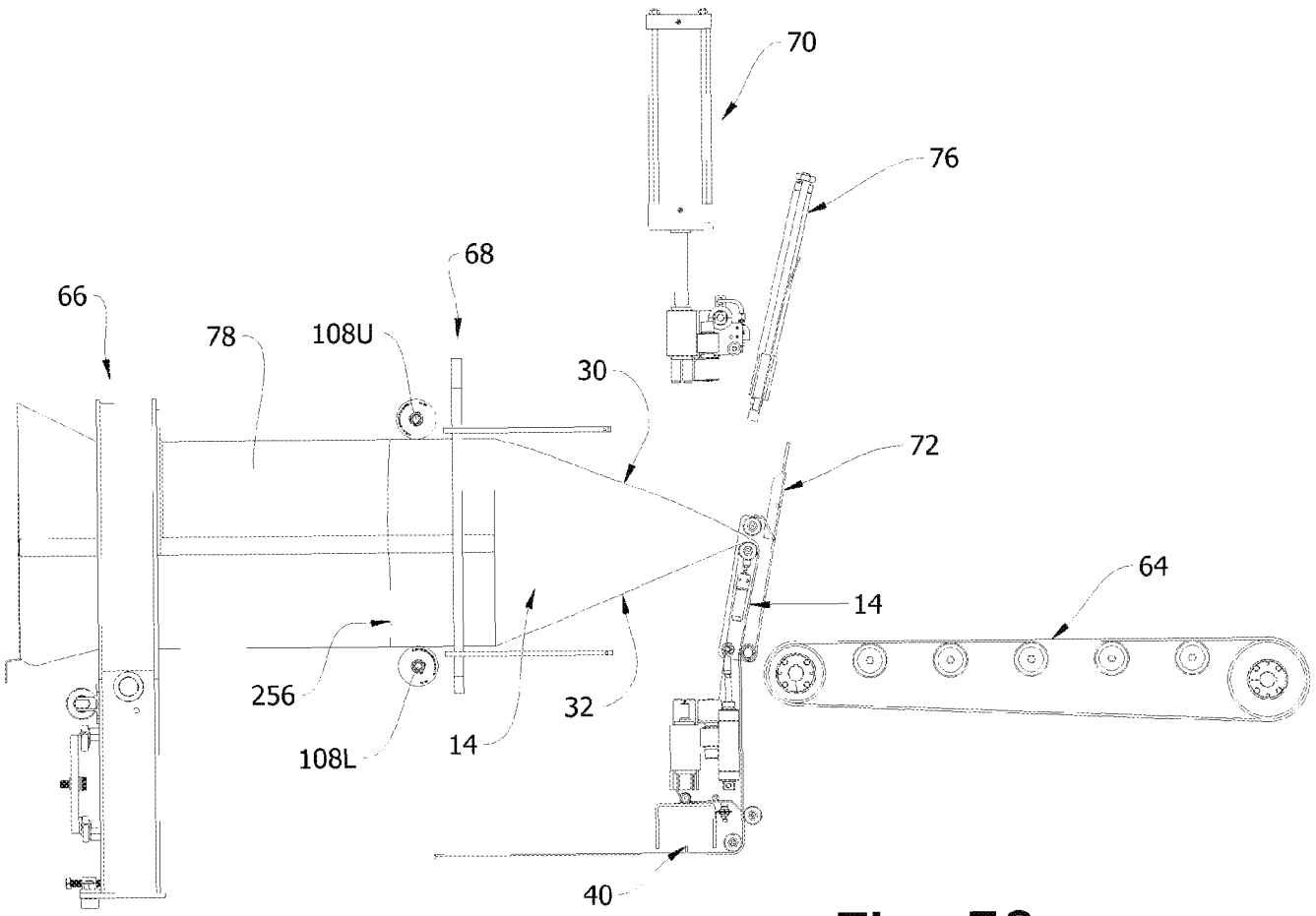
Figure 51:
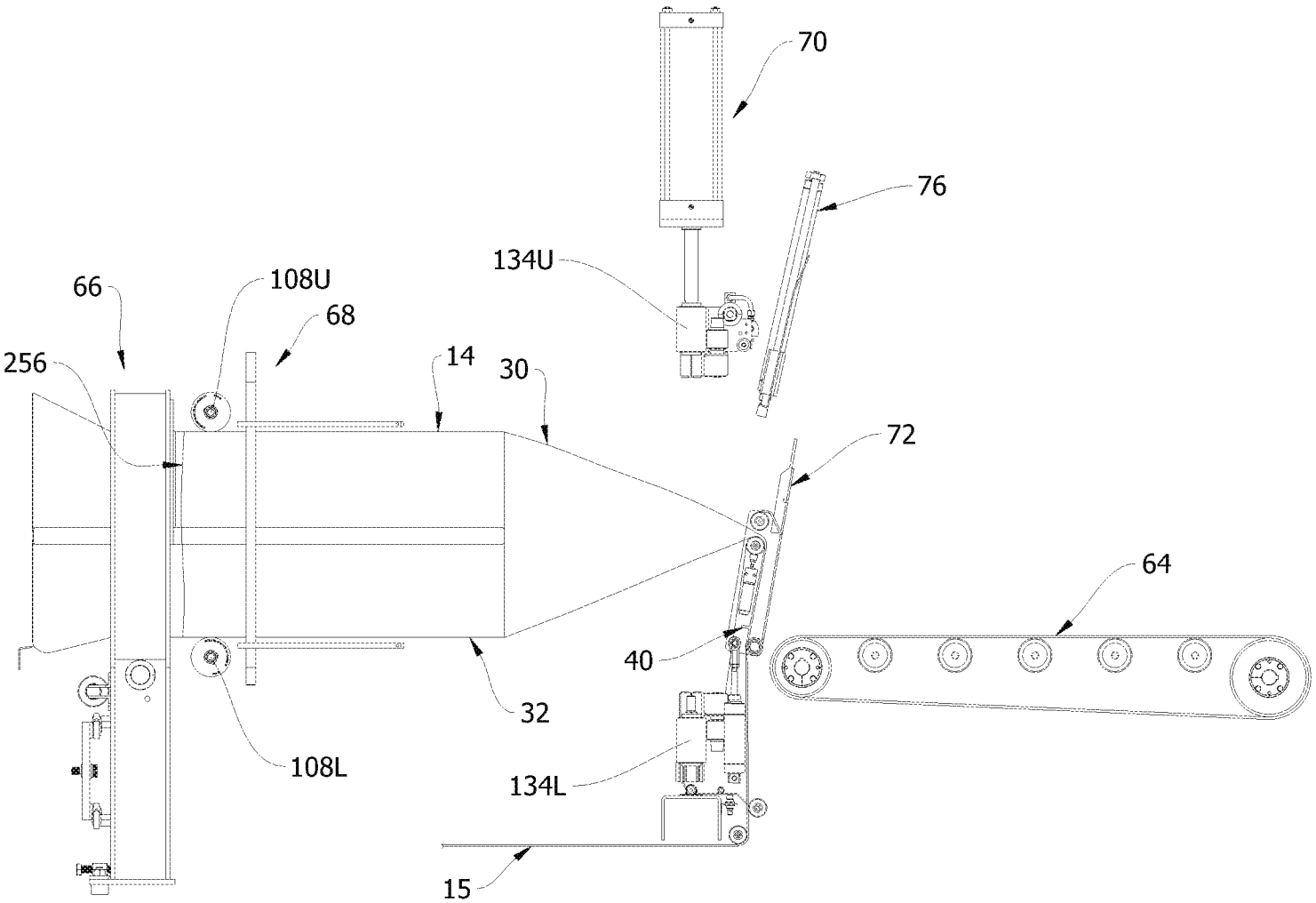
Figure 52:
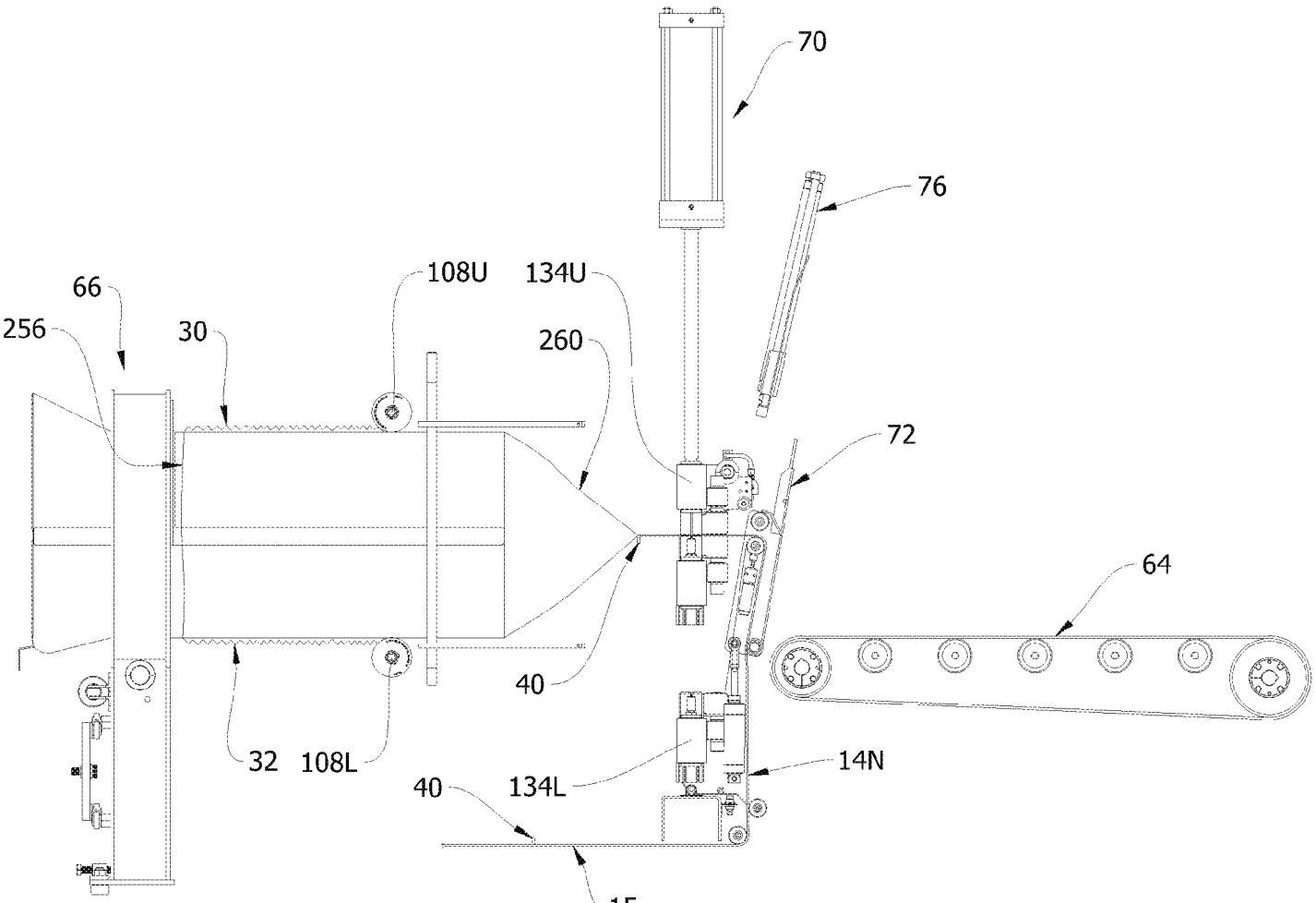

As shown in FIG. 50, the bag placer assembly 66 is then traversed toward the rear end of the form tube 66 and the drive wheels 108U, 108L are moved onto the bag 14 which is now partially located on the form tube 66. The bag placer assembly 66 is then traversed toward the form tube inlet end/front flared surface 78F as shown in FIG. 51 and then back toward the form tube rear end as shown in FIG. 52 while the drive wheels 108U, 108L are simultaneously rotatably driven for thereby further collecting the bag 14 onto the form tube 66. From the web locating control signal received from the sensor assemblies 244, apparatus 10 stops farther collection of the bag 14 onto the form tube 66 at the appropriate time and, as also shown in FIG. 52, the upper and lower jaws 134U, 134L are again extended for sandwiching the next bag 14N which will be used in the next enveloping operation/cycle. The guide roller 216 is then pushed against guide roller 214 for thereby pinching and retaining bag 14N thereat. The guillotine knife 146 is then extended as described hereinabove thereby cutting the bag 14 from the next bag 14N at the sever line 256N (FIG. 53).

Figure 53:
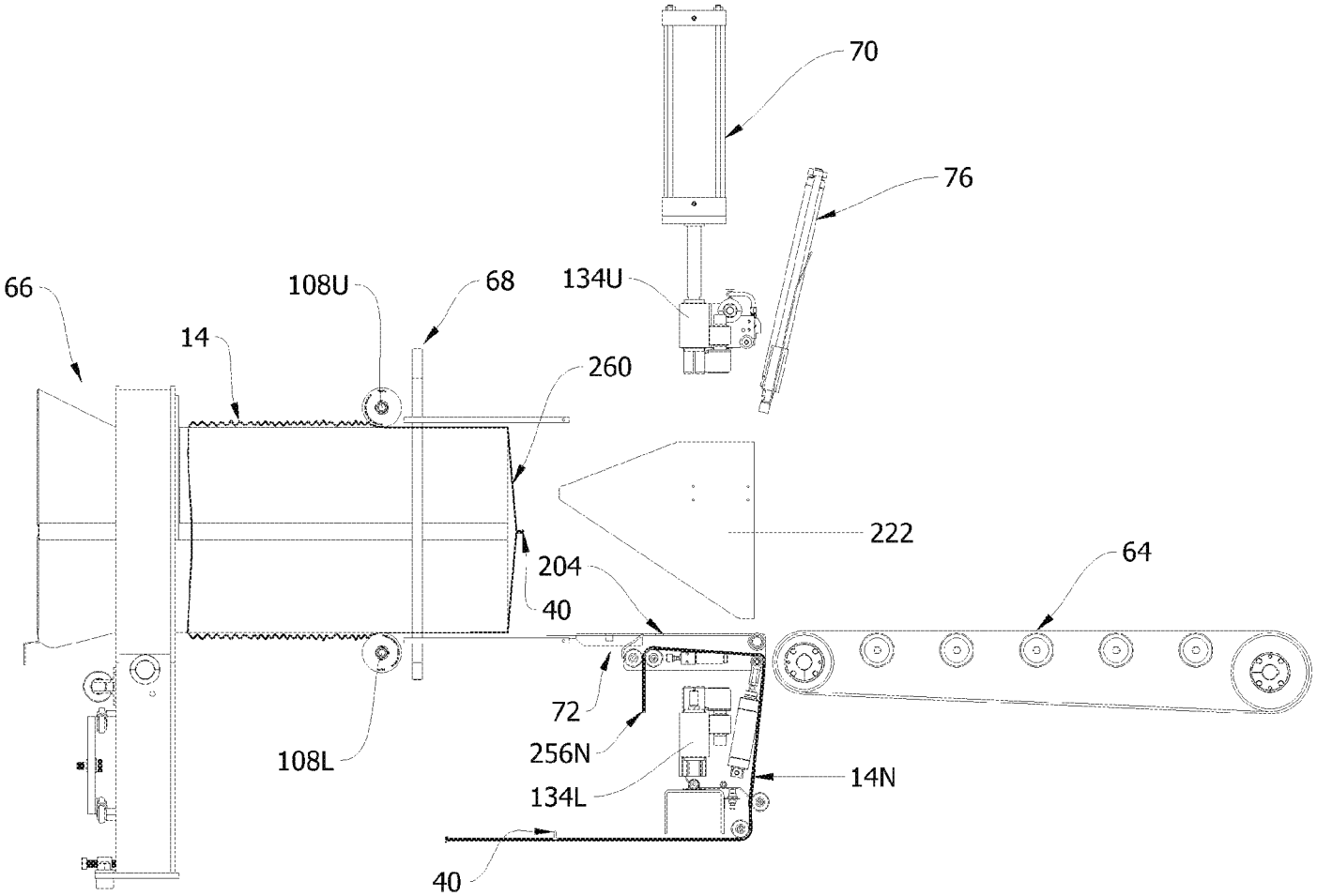

Referring now to FIG. 53, bag 14 is located on the form tube 66 and is ready for receiving a bale 12. Prior to inserting the bale 12 into the bag 14, the side fold flaps 222L, 222R are rotated and placed in their first position pointing toward the form tube 66 (as also shown in FIG. 35) for use, thereafter, when closing the bag. Also, the bottom fold plate 72 is placed in its lowered horizontal position thereby providing a transition surface for the enveloped bale as it is inserted through the form/insertion tube 66 and travels across the assembly 52 and onto the output conveyor 64. It is noted that, after the enveloped bag 14 travels through and onto the output conveyor 64, the bottom fold plate 72 can be pivoted to its vertical position as shown in FIG. 43 for repeating the enveloping process/cycle as described herein above.

With the apparatus components as depicted in FIG. 53 and the bag 14 collected on the form tube 66, a bale 12 is inserted into bag 14 by pushing the bale 12 with ram 60, as indicated by arrow S in FIG. 1, through the form tube 66 and the assembly 52 and onto the output conveyor 66. As can be appreciated, as the bale 12 travels through the form tube 66, the forward end F thereof abuts the interior surface of the closed end 260 of the bag 14 simultaneously pulling the bag off of the form tube 66 while the bale 12 is being inserted within the bag 14. When the bale 12 is fully inserted within the bag 14 and prior to closure of the bag opening 258, the enveloped bale 12 within bag 14 will appear as diagrammatically shown in FIG. 54. With the bale 12 within the bag 14 as shown, the bag opening 258 essentially comprises a lower closure bag flap 262, left and right side closure bag flaps 264L, 264R and upper closure bag flap 266.

Bag opening 258 can then be closed manually by folding over the closure bag flaps onto the bale rear end R and manually securing the flaps by stapling, sewing, heat sealing and/or with adhesives. Preferably, however, bag opening 258 is automatically closed with assembly 52 by automatically folding over the closure bag flaps onto the bale rear end R and automatically securing the flaps by heat sealing as described hereinbelow.

Figure 54:
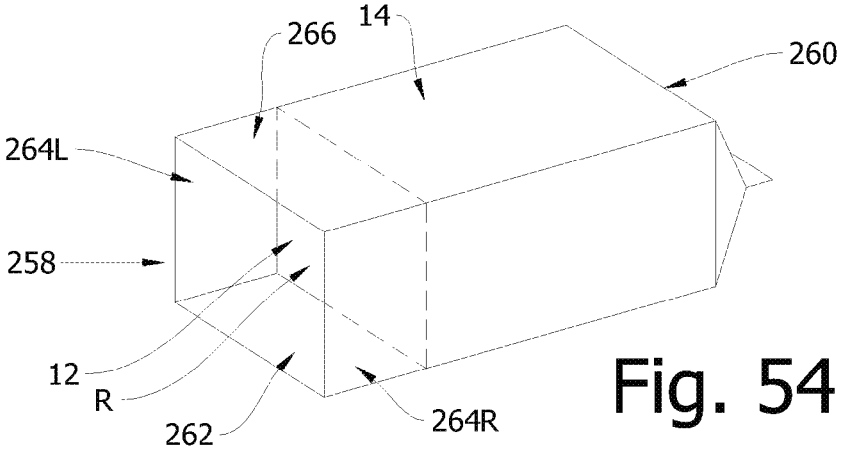
FIG. 54 is a perspective view of a bale which has been inserted into a bag and wherein the bag open end has not yet been closed.
Figure 56A:
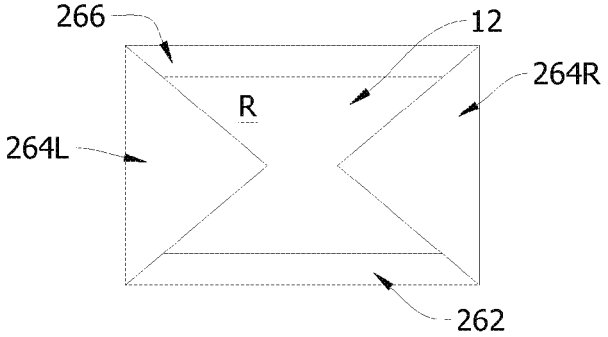
FIGS. 56-59 are perspective views similar to FIG. 55 and depicting the operation of the apparatus as the bag open end is closed; and, FIGS. 56*a*, 57*a* and 59*a* are diagrammatic rear elevation views of the open end of the enveloped bale shown in FIG. 54 depicting the folding of the bag closure flaps and process of closing and sealing the bag open end.
Figure 55:
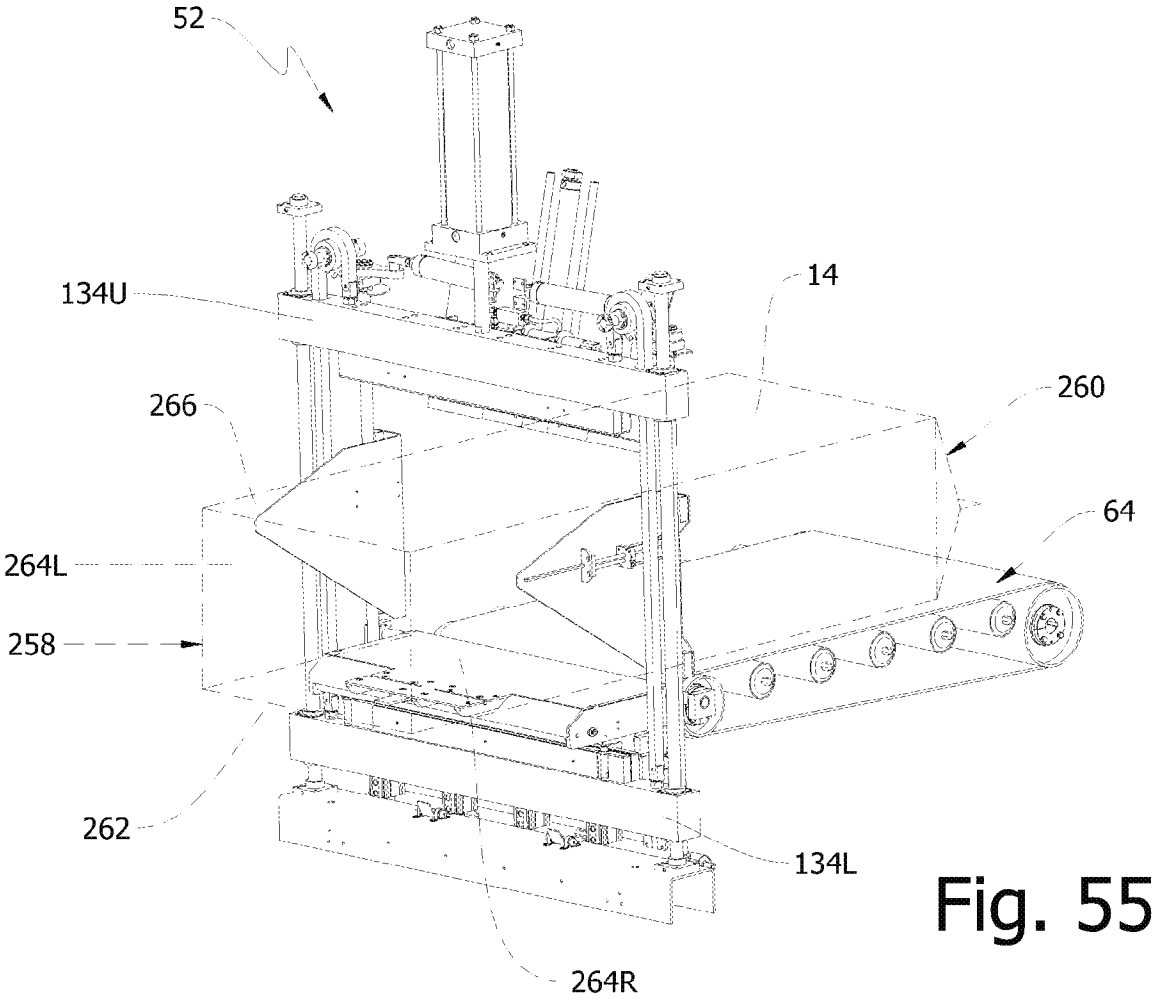
FIG. 55 is a partial perspective view of the apparatus and showing in dash lines a bag with an enveloped bale therein traveling along the bale longitudinal line of travel prior to closing the open end.
Figure 56:
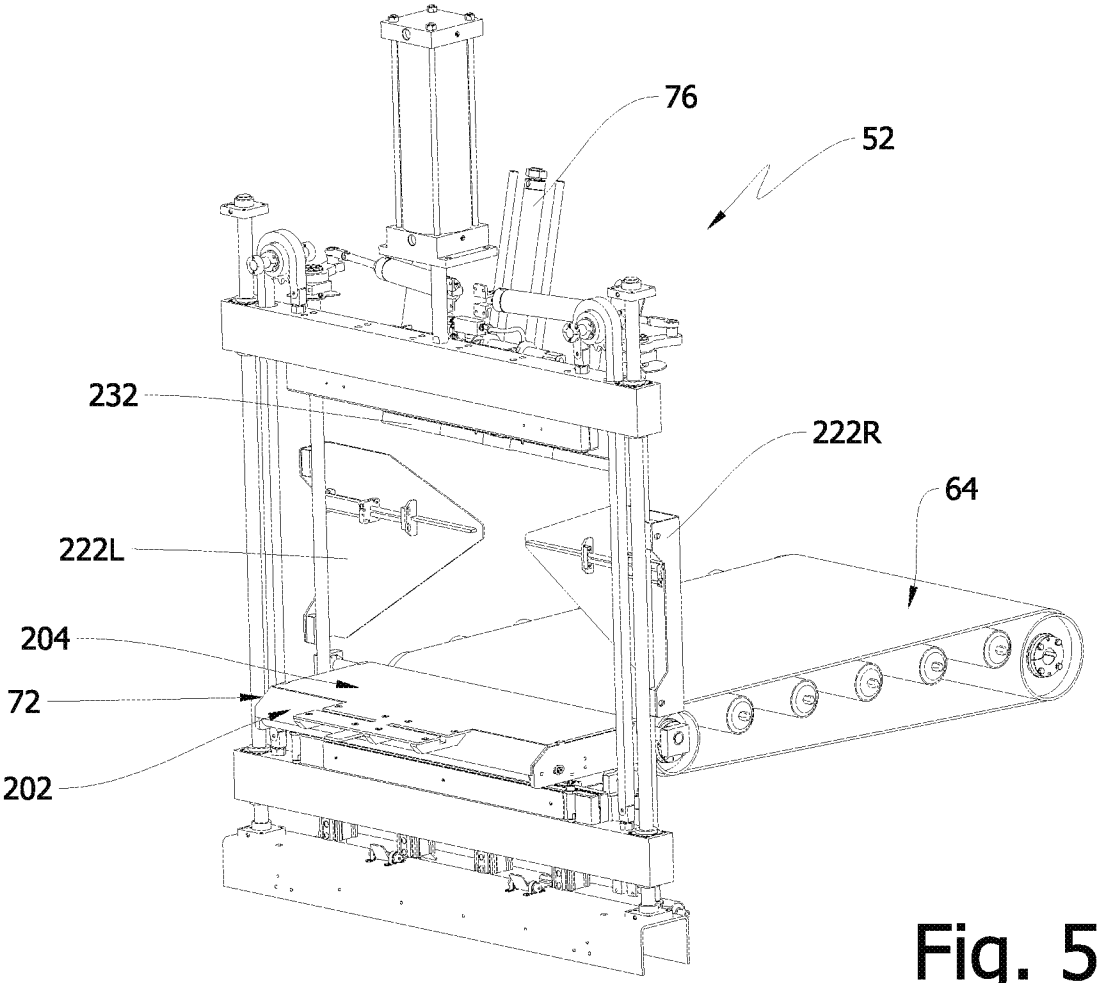

After the bale 12 has been inserted into the bag 14 as shown in FIG. 54, it travels through the assembly 52 and onto the output conveyor 64 as shown in FIG. 55 wherein the enveloped bale and bag 14 are shown in dash lines. As shown in FIGS. 56 and 56*a*, as the enveloped bale and bag 14 travel through assembly 52, the left and right side flaps 222L, 222R are pivoted into their second position, as also shown in FIG. 36, wherein they are situated transversely/perpendicular to the longitudinal travel of the bales 12. In this manner, as depicted in FIG. 56*a*, the left and right side closure bag flaps 264L, 264R are folded onto the bale rear end R.

Figure 57A:
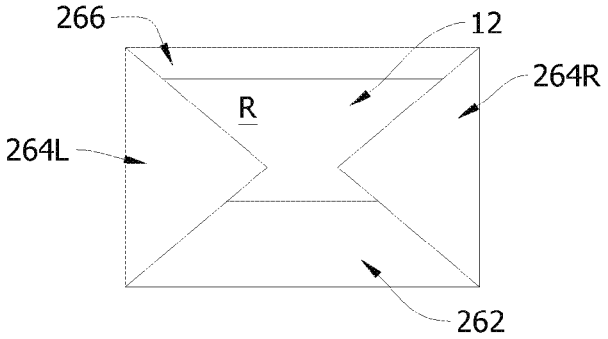
Figure 59A:
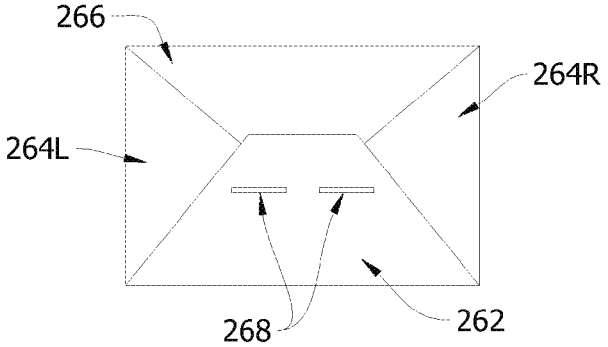
Figure 57:
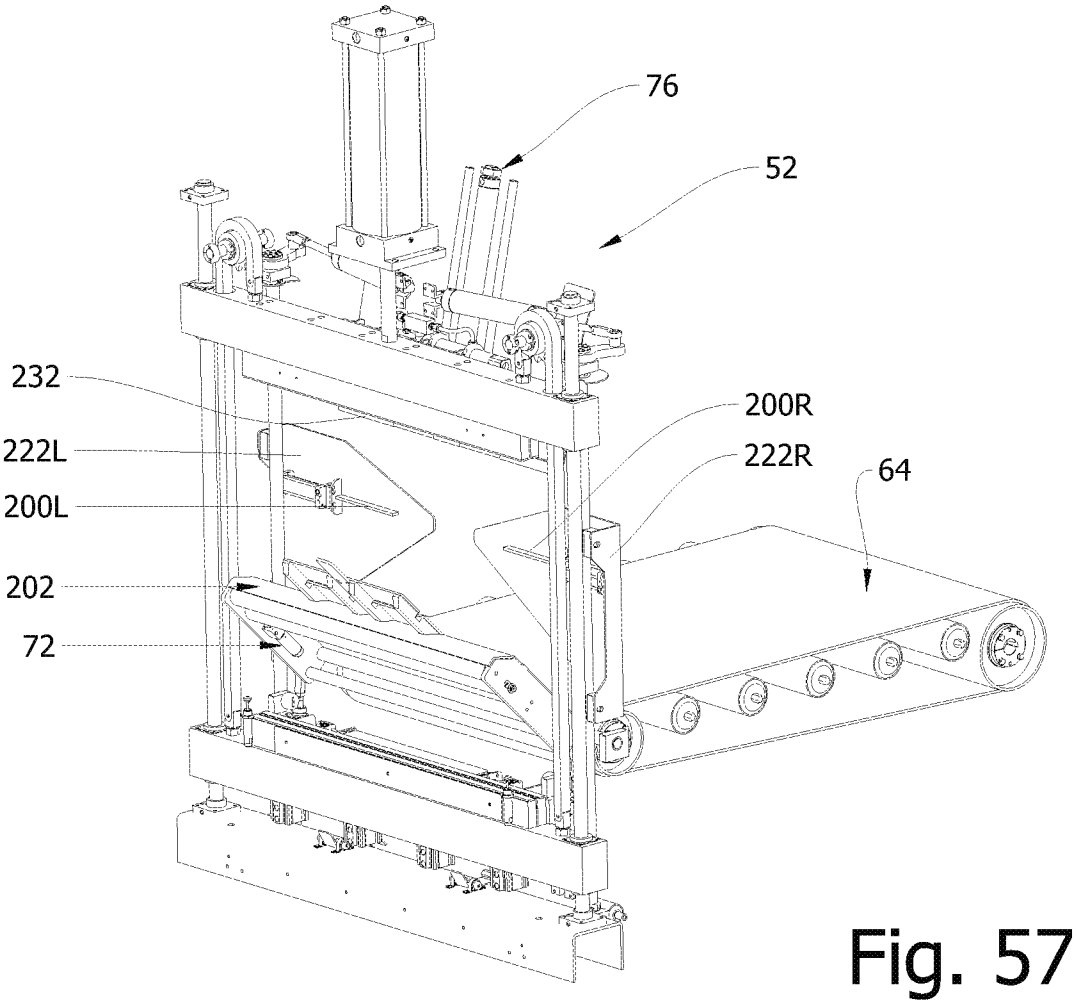
Figure 58:
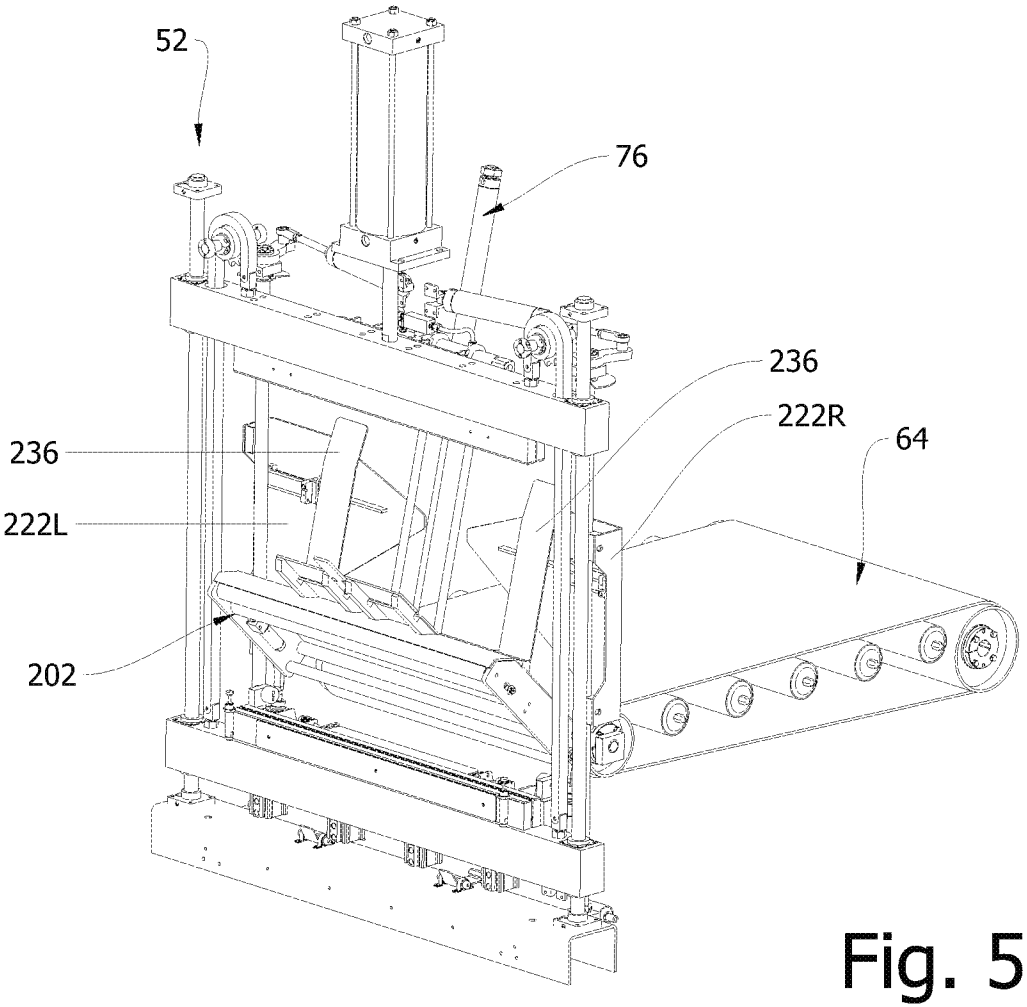
Figure 59:
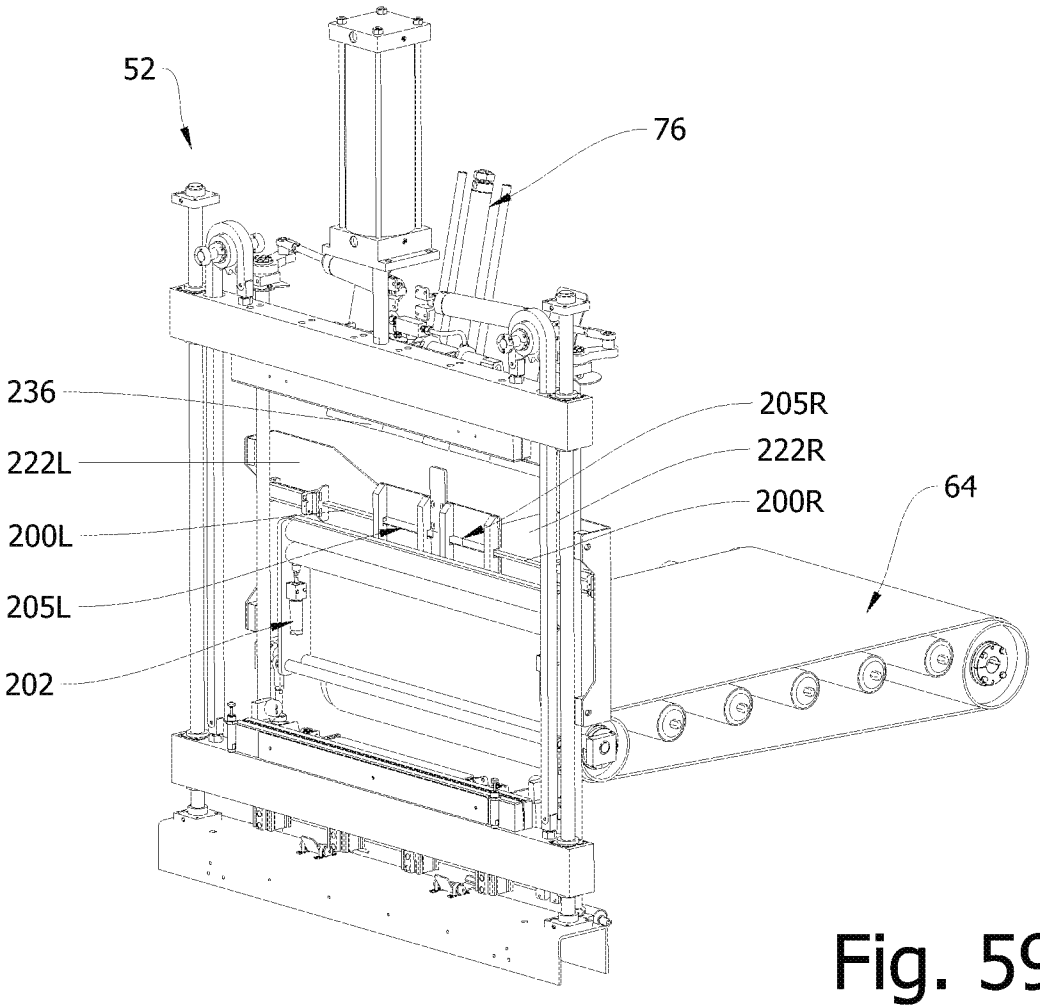

Thereafter, as shown in FIG. 57, the bottom fold plate assembly 72 is pivoted upwardly, but not yet vertically, whereby the lower closure bag flap 262 is partially folded upwardly as depicted in FIG. 57*a*. As shown in FIG. 58, the top fold bar 232 of the top fold assembly 76 is then extended thereby wiping the upper closure bag flap 266 downwardly generally over the left and right side closure bag flaps 264L, 264R and inside of the lower closure bag flap 262. As the top fold bar 232 is retracted, the bottom fold plate assembly 72 is then pivoted to a vertical position as shown in FIG. 59 whereat the lower closure bag flap 262 is also folded and pressed against the bale rear end R as depicted in FIG. 59*a*. In this position, the left and right closure bag flaps 264L, 264R and the upper closure bag flap 266 are sandwiched between the bale rear end R and the lower closure bag flap 262. The closure bag flaps 262, 264L, 264R and 266 are then securely joined/attached to one another such as by stapling, sewing, heat sealing and/or with adhesives.

Preferably, the closure bag flaps 262, 264L, 264R and 266 are heat sealed/fused automatically with the heat sealing assembly 156. In this regard, jaw 134U is extended for placing the heat sealing assembly 156 adjacent the closure bag flaps whereby heat can be applied and the closure bag flaps 262, 264L, 264R and 266 sealed/fused to one another. In this regard, it has been found that, when bag 14 is made of thin polypropylene material, the application of heat to the closure bag flaps can create undesirable holes therethrough. So as to avoid this, as mentioned hereinabove selectively extendable slack bars 200L, 200R are provided on the left and right side flaps 222L, 222R. After the left and right side flaps 222L, 222R are pivoted and the left and right side closure bag flaps 264L, 264R are folded onto the bale rear end R as shown in FIGS. 56 and 56*a*, the slack bars 200L, 200R are extended as shown in FIG. 38. The left and right side flaps 222L, 222R remain in this position as the upper closure bag flap 266 and the lower closure bag flap 262 are folded thereover. Thus, when the bottom fold plate assembly 72 is pivoted to a vertical position as shown in FIG. 59, the left and right slack bars 200L, 200R are received within the respective left and right guide slots 205L, 205R in the plate assembly 202. The upper closure bag flap 266 and the lower closure bag flap 262 are thereby forced into the left and right guide slots 205L, 205R and create lines of slack/additional material 268.

Accordingly, for heat sealing/fusing the closure bag flaps, jaw 134U is extended for placing the heat sealing assembly 156 adjacent the slack lines 268 and directing hot air from the manifold orifices 168 to the slack lines 268. When a sufficient amount of heat has been delivered, the press plates 170 are extended and pressed against the partially melted slack lines 268 of polypropylene thereby assuring that all of the closure bag flaps 262, 264L, 264R and 266 are heat sealed/fused together.

Finally, it is noted that, as the now closed bag 14 travels away from the assembly 52 on the output conveyor 64, the left and right side flaps 222L, 222R are pivoted toward the conveyor 64 and toward the position shown in FIG. 37 whereby the side flaps 222L, 222R are withdrawn from between the left and right closure bag flaps 264L, 264R and the upper and lower closure bag flaps 266, 262.

While this invention has been described as having an exemplary design, the present invention may be further modified within the spirit and scope of this disclosure. This application is therefore intended to cover any variations, uses, or adaptations of the invention using its general principles.

What is claimed is:

1. In a machine for enveloping bales of material with preformed bags having an open end and a closed end, an apparatus for placing the bags over an insertion tube comprising:

a plurality of fingers, said fingers being moveable into the open end of said bags and over the insertion tube and being selectively retractable and extendable;

a plurality of roller drive wheels, said roller drive wheels being rotatable and moveable in and out of engagement with the insertion tube; and, wherein said plurality of fingers and said roller drive wheels are carried on a common assembly which is moveable along the insertion tube.

2. In a method for enveloping bales of material with preformed bags having an open end and a closed end, a method of placing a bag over an insertion tube whereby a bale can be inserted into the bag, said method of placing a bag over the insertion tube comprising the steps of:

inserting a plurality of fingers into said bag through said open end;

extending said fingers and engaging the bag;

traversing said fingers relative to the insertion tube and inserting the insertion tube into said bag opening;

retracting said fingers;

removing said fingers from inside said bag and leaving the bag on said insertion tube; and, after the step of removing, placing a plurality of roller drive wheels on said bag and sandwiching the bag between the insertion tube and each of said wheels, and rotatably driving said wheels thereby slidingly collecting said bag on said insertion tube.

3. The method of claim 2 further comprising, prior to said step of placing, expanding and locating said insertion tube in close proximity to the interior surface of the bag.

4. The method of claim 3 further comprising inserting a bale through said insertion tube and into the bag thereby removing the bag from the insertion tube and enveloping the bale.

5. In a method for enveloping bales of material with preformed bags having an open end and a closed end, a method of placing a bag over an insertion tube whereby a bale can be inserted into the bag, said method of placing a bag over the insertion tube comprising the steps of:

inserting a plurality of fingers into said bag through said open end;

extending said fingers and engaging the bag;

traversing said fingers relative to the insertion tube and inserting the insertion tube into said bag opening;

retracting said fingers;

removing said fingers from inside said bag and leaving the bag on said insertion tube; and after the step of removing, placing a plurality of frictional engagement members on said bag and sandwiching the bag between the insertion tube and each of said members, and traversing said members along said insertion tube thereby slidingly collecting said bag on said insertion tube.

6. The method of claim 5 further comprising:

prior to said step of placing, expanding and locating said insertion tube in close proximity to the interior surface of the bag; and, inserting a bale through said insertion tube and into the bag thereby removing the bag from the insertion tube and enveloping the bale.

7. In a method for enveloping bales of material with preformed bags having an open end and a closed end, a method of placing a bag over an insertion tube whereby a bale can be inserted into the bag, said method of placing a bag over the insertion tube comprising the steps of:

inserting a plurality of fingers into said bag through said open end;

extending said fingers and engaging the bag;

traversing said fingers relative to the insertion tube and inserting the insertion tube into said bag opening;

retracting said fingers;

removing said fingers from inside said bag and leaving the bag on said insertion tube;

after the step of removing, placing a plurality of roller drive wheels on said bag and sandwiching the bag between the insertion tube and each of said wheels, and traversing said wheels along said insertion tube and rotatably driving said wheels thereby slidingly collecting said bag on said insertion tube.

8. The method of claim 7 further comprising, prior to said step of placing, expanding and locating said insertion tube in close proximity to the interior surface of the bag.

9. The method of claim 8 further comprising inserting a bale through said insertion tube and into the bag thereby removing the bag from the insertion tube and enveloping the bale.

* * * * *